US007330684B2

(12) United States Patent
Okamoto

(10) Patent No.: US 7,330,684 B2
(45) Date of Patent: Feb. 12, 2008

(54) DEVELOPING DEVICE, IMAGE FORMING APPARATUS, IMAGE FORMING SYSTEM, CHARGING MEMBER, AND METHOD FOR MANUFACTURING DEVELOPING DEVICE

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 11/221,580

(22) Filed: Sep. 7, 2005

(65) Prior Publication Data

US 2006/0056880 A1 Mar. 16, 2006

(30) Foreign Application Priority Data

Sep. 14, 2004 (JP) ..... 2004-267024
Sep. 14, 2004 (JP) ..... 2004-267025

(51) Int. Cl.
*G03G 15/08* (2006.01)

(52) U.S. Cl. ..... 399/284; 399/285; 399/286

(58) Field of Classification Search ..... 399/107, 399/119, 279, 284, 285, 286
See application file for complete search history.

(56) References Cited

U.S. PATENT DOCUMENTS 4,841,332 A * 6/1989 Haneda et al. ..... 399/270
5,451,713 A * 9/1995 Suzuki et al. ..... 399/285
5,895,150 A * 4/1999 Watabe et al. ..... 399/284
5,933,692 A * 8/1999 Niwano et al. ..... 399/284

FOREIGN PATENT DOCUMENTS

JP 10-198158 7/1998
JP 2000-214659 8/2000

* cited by examiner

*Primary Examiner*—Hoan Tran
(74) *Attorney, Agent, or Firm*—Hogan & Hartson LLP

(57) ABSTRACT

A developing device that can suppress occurrence of fogging is achieved. The developing device is provided with: a developer bearing member for bearing a developer; and a charging member for charging the developer borne by the developer bearing member. The charging member has: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer.

20 Claims, 15 Drawing Sheets

DEVELOPING DEVICE, IMAGE FORMING APPARATUS, IMAGE FORMING SYSTEM, CHARGING MEMBER, AND METHOD FOR MANUFACTURING DEVELOPING DEVICE

CROSS-REFERENCE TO RELATED APPLICATIONS

The present application claims priority upon Japanese Patent Application No. 2004-267024 filed on Sep. 14, 2004 and Japanese Patent Application No. 2004-267025 filed on Sep. 14, 2004, which are herein incorporated by reference.

BACKGROUND OF THE INVENTION

1. Field of the Invention

The present invention relates to developing devices, image forming apparatuses, image forming systems, charging members, and methods for manufacturing developing devices.

2. Description of the Related Art

Image forming apparatuses such as laser beam printers are well known. Such image forming apparatuses include, for example, an image bearing member for bearing a latent image, and a developing device for developing the latent image borne by the image bearing member with a developer. When the image forming apparatus receives image signals etc. from an external device such as a host computer, it positions the developing device at a developing position which is in opposition to the image bearing member, develops the latent image borne on the image bearing member with the developer contained in the developing device to form a developer image, and transfers the developer image onto a medium to ultimately form an image on the medium.

This developing device further includes, for example, a developer bearing member for bearing the developer, and a charging member that is placed in contact with the developer bearing member for electrically charging the developer borne by the developer bearing member. (See, for example, JP 2000-214659A.)

(1) This charging member includes a conductive agent for providing the charging member with conductivity. Furthermore, in order to electrically charge the developer borne by the developer bearing member with the desired charge amount, it is necessary to disperse, as a whole, a sufficient amount of conductive agent throughout the charging member.

On the other hand, when looking at the portion where the charging member is placed in contact with the developer bearing member, it can be seen that the more the developing device is used, the more of the surface contacting the developer bearing member is worn off, and the more of the conductive agent is exposed. In this case, a decrease in the charge amount of the developer is promoted due to the developer contacting the exposed conductive agent. Moreover, when the charge amount of the developer decreases too much, there is a possibility that developer with little charge amount is borne by the developer bearing member, and fogging may occur.

(2) Moreover, the charging member may be formed by centrifugal molding, in which the material of the charging member is supplied into a hollow die having an inner wall, and the die is rotated, thus molding the charging member. In this case, a portion in which the developer is dispersed will be formed in the charging member on the side that is proximate to the inner wall of the die and a portion where almost no developer is present will be formed in the charging member on the side that is distant to the inner wall, due to the centrifugal force during the molding. Moreover, at the boundary between these two portions, the conductive agent is dispersed non-uniformly.

In conventional developing devices, the surface on the side distant from the inner wall is placed in contact with the developer bearing member. In this case, there is a possibility that the developer is charged non-uniformly, and stripes may appear in the developer image formed on the image bearing member.

SUMMARY OF THE INVENTION

The present invention has been made in view of the above-mentioned issues, and one object of the present invention is to suppress the occurrence of fogging. It is another object of the present invention to suppress the occurrence of stripes.

(1) One aspect of the present invention is a developing device comprising: a developer bearing member for bearing a developer; and a charging member for charging the developer borne by the developer bearing member, the charging member having: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer.

(2) Another aspect of the present invention is a developing device comprising: a developer bearing member for bearing a developer; and a charging member for charging the developer borne by the developer bearing member, the charging member containing a conductive agent, the charging member being molded through centrifugal molding by supplying a material of the charging member into a hollow die having an inner wall and rotating the die, a surface of the charging member that is on a side proximate to the inner wall being placed in contact with the developer bearing member.

Other features of the present invention will become clear through the accompanying drawings and the description of the present specification.

DETAILED DESCRIPTION OF THE INVENTION

Figure 1:
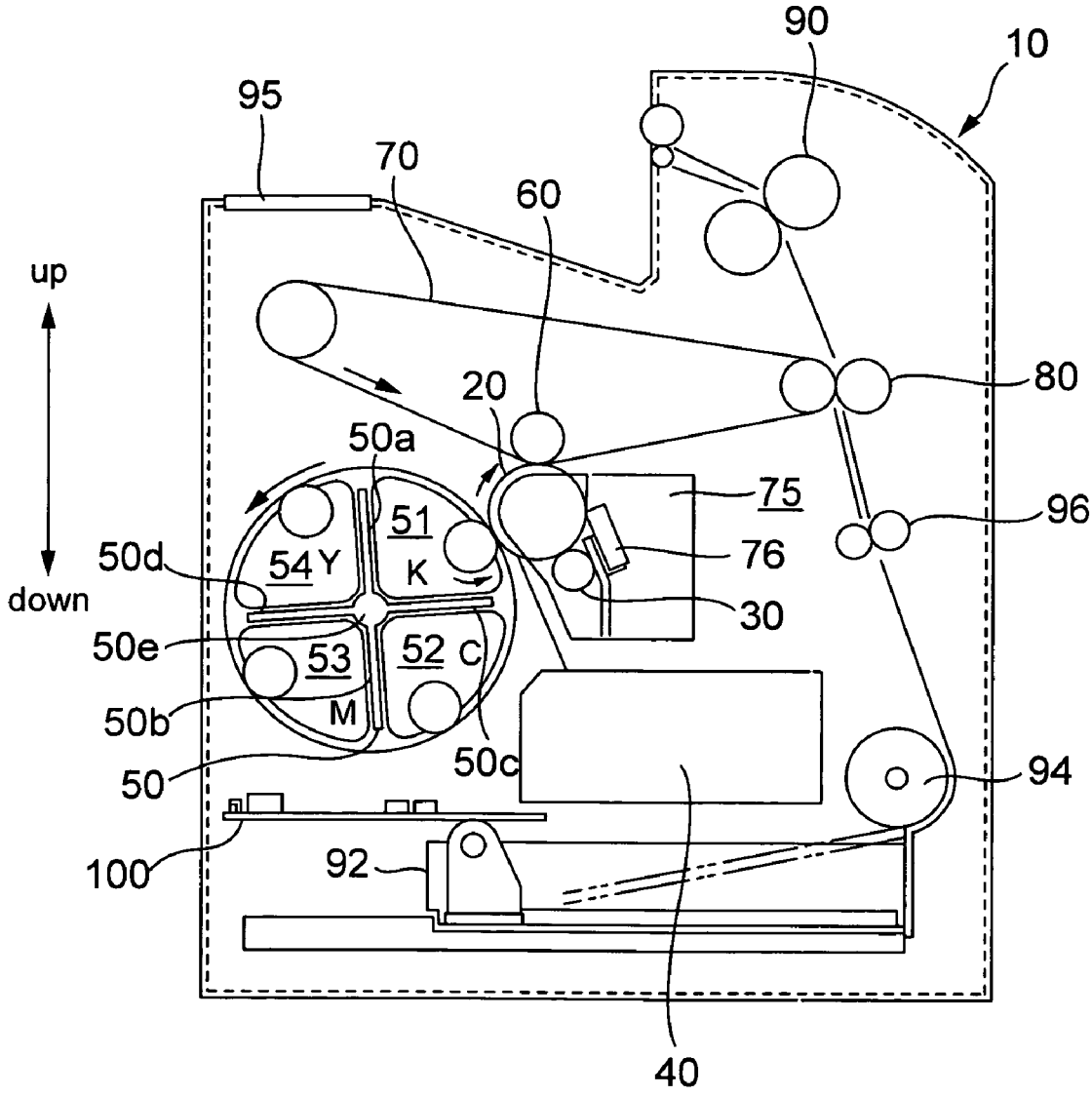
FIG. 1 is a diagram showing the main structural components constituting a printer 10.

At least the following matters will be made clear by the present specification and the accompanying drawings.

(1) One aspect of the present invention is a developing device comprising: a developer bearing member for bearing a developer; and a charging member for charging the developer borne by the developer bearing member, the charging member having: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer.

With such a developing device, the developer borne by the developer bearing member can be charged appropriately, so that it is possible to suppress the occurrence of fogging.

In the above-described developing device, the charging member may be molded by centrifugal molding, in which a material of the charging member is supplied into a hollow die having an inner wall, and the die is rotated to mold the charging member.

In this way, it is easy to obtain the charging member.

In the above-described developing device, to mold the charging member by centrifugal molding, a material of the first layer may be supplied into the die and the die may be rotated, and then a material of the second layer may be supplied into the die and the die may be rotated.

In this way, the conductive agent is dispersed uniformly near the surface of the first layer that is placed in contact with the developer bearing member, so that it becomes possible to charge the developer borne by the developer bearing member uniformly, and to suppress the occurrence of stripes.

In the above-described developing device, the conductive agent may be carbon black.

Carbon black is advantageous with regard to cost, and moreover can sustain a suitable conductivity even in the event of environmental changes.

In the above-described developing device, the first layer may contain an ionic conductive agent.

In this way, the amount of conductive agent (other than the ionic conductive agent) can be made small, so that the amount of exposed conductive agent is reduced, and a decrease of the charge amount of the developer borne by the developer bearing member can be advantageously prevented. Therefore, if the first layer contains an ionic conductive agent, then the occurrence of fogging can be suppressed effectively.

It is also possible to achieve a developing device comprising: a developer bearing member for bearing a developer; and a charging member for charging the developer borne by the developer bearing member, the charging member having: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer; wherein the charging member is molded by centrifugal molding, in which a material of the charging member is supplied into a hollow die having an inner wall, and the die is rotated to mold the charging member; wherein, to mold the charging member by centrifugal molding, a material of the first layer is supplied into the die and the die is rotated, and then a material of the second layer is supplied into the die and the die is rotated; wherein the conductive agent is carbon black; and wherein the first layer contains an ionic conductive agent.

With such a developing device, the effect of being able to suppress the occurrence of fogging is attained most advantageously.

It is also possible to achieve an image forming apparatus comprising: an image bearing member for bearing a latent image; and a developing device for developing the latent image borne by the image bearing member, the developing device including: a developer bearing member for bearing a developer; and a charging member for charging the developer borne by the developer bearing member, the charging member having: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer.

With such an image forming apparatus, it is possible to suppress the occurrence of fogging, and an image forming apparatus that is superior to conventional ones can be realized.

It is also possible to achieve an image forming system comprising: a computer; and an image forming apparatus that can be connected to the computer and that is provided with: an image bearing member for bearing a latent image; and a developing device for developing the latent image borne by the image bearing member, the developing device including: a developer bearing member for bearing a developer; and a charging member for charging the developer borne by the developer bearing member, the charging member having: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer.

With such an image forming system, it is possible to suppress the occurrence of fogging, and an image forming system that is superior to conventional ones can be realized.

It is also possible to achieve a charging member for charging a developer borne by a developer bearing member, the charging member comprising: a first layer that is placed in contact with the developer bearing member and that contains a conductive agent; and a second layer that is positioned on a side opposite from the developer bearing member with respect to the first layer, and that contains a conductive agent at a density that is greater than the density of the conductive agent contained in the first layer.

With such a charging member, it is possible to suppress the occurrence of fogging.

It is also possible to achieve a method for manufacturing a developing device, the developing device including a developer bearing member for bearing a developer and a charging member for charging the developer borne by the developer bearing member, the charging member having a first layer that contains a conductive agent and a second layer that contains a conductive agent at a density that is greater than the density of the conductive agent contained in the first layer, the method comprising: a step of molding the charging member through centrifugal molding, by: supplying a material of the first layer into a hollow die having an inner wall and rotating the die, and then supplying a material of the second layer into the hollow die and rotating the die; and a step of placing the first layer of the charging member molded by the centrifugal molding in contact with the developer bearing member, and positioning the second layer of the charging member on a side opposite from the developer bearing member with respect to the first layer.

With such a method for manufacturing a developing device, it is possible to suppress the occurrence of fogging, and to suppress the occurrence of stripes.

(2) Another aspect of the present invention is a developing device comprising: a developer bearing member for bearing a developer; and a charging member for charging the developer borne by the developer bearing member, the charging member containing a conductive agent, the charging member being molded through centrifugal molding by supplying a material of the charging member into a hollow die having an inner wall and rotating the die, a surface of the charging member that is on a side proximate to the inner wall being placed in contact with the developer bearing member.

With such a developing device, the surface that is proximate to the inner wall, in which the developer is dispersed uniformly, is placed in contact with the developer bearing member, so that the developer can be charged appropriately, and the occurrence of stripes can be suppressed.

In this developing device, the conductive agent may be carbon black.

Carbon black is advantageous with regard to cost, and moreover can sustain a suitable conductivity even in the event of environmental changes.

In the above-described developing device, the charging member may have a first layer, and a second layer containing a conductive agent at a density that is greater than the density of the conductive agent contained in the first layer; and to mold the charging member by centrifugal molding, a material of the first layer may be supplied into the die and the die may be rotated, and then a material of the second layer may be supplied into the die and the die may be rotated.

In this way, a sufficient amount of a conductive agent with a sufficient charge can be ensured, and the developer borne by the developer bearing member can be charged appropriately, so that the occurrence of fogging can be suppressed.

In the above-described developing device, the first layer may contain an ionic conductive agent.

In this way, the amount of conductive agent (other than the ionic conductive agent) can be made small, so that the possibility of the conductive agent being dispersed unevenly can be reduced. Therefore, if the first layer contains an ionic conductive agent, then the occurrence of stripes can be suppressed effectively.

It is also possible to achieve a developing device comprising: a developer bearing member for bearing a developer; and a charging member for charging the developer borne by the developer bearing member, the charging member containing a conductive agent, the charging member being molded through centrifugal molding by supplying a material of the charging member into a hollow die having an inner wall and rotating the die, a surface of the charging member that is on a side proximate to the inner wall being placed in contact with the developer bearing member; wherein the conductive agent is carbon black; wherein the charging member has a first layer, and a second layer containing a conductive agent at a density that is greater than the density of the conductive agent contained in the first layer; wherein, to mold the charging member by centrifugal molding, a material of the first layer is supplied into the die and the die is rotated, and then a material of the second layer is supplied into the die and the die is rotated; and wherein the first layer contains an ionic conductive agent.

With such a developing device, the effect of being able to suppress the occurrence of stripes can be attained most advantageously.

It is also possible to achieve an image forming apparatus comprising: an image bearing member for bearing a latent image; and a developing device for developing the latent image borne by the image bearing member, the developing device including: a developer bearing member for bearing a developer; and a charging member for charging the developer borne by the developer bearing member, the charging member containing a conductive agent, the charging member being molded through centrifugal molding by supplying a material of the charging member into a hollow die having an inner wall and rotating the die, a surface of the charging member that is on a side proximate to the inner wall being placed in contact with the developer bearing member.

With such an image forming apparatus, it is possible to suppress the occurrence of stripes, and to realize an image forming apparatus that is superior to conventional image forming apparatuses.

In this image forming apparatus, the developer bearing member may be arranged in opposition to the image bearing member with a gap therebetween; and the latent image may be developed with the developer borne by the developer bearing member by applying, to the developer bearing member, a voltage obtained by superposing an AC voltage over a DC voltage (so-called jumping development).

In the case of so-called jumping development, the charged developer is caused to jump between the developer bearing member and the image bearing member to develop the latent image due to an electric field formed between the developer bearing member and the image bearing member, so that non-uniformities in the charge amount of the developer borne by the developer bearing member tend to affect the developer image formed on the image bearing member. Therefore, if the charge amount of the developer is non-uniform, stripes tend to occur in the developer image, so that in the case of so-called jumping development, the above-noted effect of being able to suppress the occurrence of stripes can be attained even more advantageously.

It is also possible to achieve an image forming system comprising: a computer; and an image forming apparatus that can be connected to the computer and that is provided with: an image bearing member for bearing a latent image; and a developing device for developing the latent image borne by the image bearing member, the developing device including: a developer bearing member for bearing a developer; and a charging member for charging the developer borne by the developer bearing member, the charging member containing a conductive agent, the charging member being molded through centrifugal molding by supplying a material of the charging member into a hollow die having an inner wall and rotating the die, a surface of the charging member that is on a side proximate to the inner wall being placed in contact with the developer bearing member.

With such an image forming system, the occurrence of stripes can be suppressed, and an image forming system that is superior to conventional image forming systems can be realized.

It is also possible to achieve a charging member for charging a developer borne by a developer bearing member, wherein: the charging member contains a conductive agent; the charging member is molded through centrifugal molding by supplying a material of the charging member into a hollow die having an inner wall and rotating the die; and a surface of the charging member that is on a side proximate to the inner wall is placed in contact with the developer bearing member.

With such a charging member, it is possible to suppress the occurrence of stripes.

It is also possible to achieve a method for manufacturing a developing device, the developing device including a developer bearing member for bearing a developer and a charging member for charging the developer borne by the developer bearing member, the charging member containing a conductive agent, the method comprising: a step of molding the charging member through centrifugal molding, by: supplying a material of the charging member into a hollow die having an inner wall and rotating the die; and a step of placing, in contact with the developer bearing member, a surface of the charging member molded by the centrifugal molding that is on a side proximate to the inner wall.

With such a method for manufacturing a developing device, it is possible to manufacture a developing device that can suppress the occurrence of stripes.

Outline of Image Forming Apparatus

Next, with reference to FIG. 1, an outline of a laser beam printer (hereinafter, also referred to as "printer") 10 serving as an example of an image forming apparatus is described. FIG. 1 is a diagram showing the main structural components constituting the printer 10. It should be noted that in FIG. 1, the vertical direction is shown by the arrows, and, for example, a paper supply tray 92 is arranged at a lower section of the printer 10 and a fusing unit 90 is disposed at an upper section of the printer 10.

As shown in FIG. 1, the printer 10 according to the present embodiment includes a charging unit 30, an exposing unit 40, a developing-unit holding unit 50, a first transferring unit 60, an intermediate transferring member 70, and a cleaning unit 75. These units are arranged in the direction of rotation of a photoconductor 20, which serves as an example of an image bearing member. The printer 10 further includes a second transferring unit 80, a fusing unit 90, a displaying unit 95 constituted by a liquid-crystal panel and serving as a means for making notifications to the user, and a control unit 100 for controlling these units and managing the operations of the printer.

The photoconductor 20 has a cylindrical conductive base and a photoconductive layer formed on the outer peripheral surface of the conductive base, and is rotatable about its central axis. In the present embodiment, the photoconductor 20 rotates clockwise, as shown by the arrow in FIG. 1.

The charging unit 30 is a device for electrically charging the photoconductor 20. The exposing unit 40 is a device for forming a latent image on the charged photoconductor 20 by irradiating a laser beam thereon. The exposing unit 40 has, for example, a semiconductor laser, a polygon mirror, and an F-θ lens, and irradiates a modulated laser beam onto the charged photoconductor 20 according to image signals that have been input from a not-shown host computer such as a personal computer or a word processor.

The developing-unit holding unit 50 is a device for developing the latent image formed on the photoconductor 20 using toner T, which is an example of a developer contained in developing units, that is, black (K) toner contained in a black developing unit 51, magenta (M) toner contained in a magenta developing unit 53, cyan (C) toner contained in a cyan developing unit 52, and yellow (Y) toner contained in a yellow developing unit 54.

The developing-unit holding unit 50 rotates when the four developing units 51, 52, 53, and 54, which serve as an example of developing devices, are mounted, thereby making it possible to move the positions of these four developing units 51, 52, 53, and 54. More specifically, the developing-unit holding unit 50 holds the four developing units 51, 52, 53, and 54 with four attach/detach sections 50*a*, 50*b*, 50*c*, and 50*d*, respectively, and the four developing units 51, 52, 53, and 54 can be rotated about a rotating shaft 50*e* while maintaining their relative positions. Every time the image formation corresponding to one page is finished, different one of the developing units is caused to selectively oppose the photoconductor 20, thereby successively developing the latent image formed on the photoconductor 20 using the toner T contained in the developing units 51, 52, 53, and 54. It should be noted that the four developing units 51, 52, 53 and 54 can be attached to and detached from the attach/detach sections of the developing-unit holding unit 50. Details on the developing units are described further below.

The first transferring unit 60 is a device for transferring, onto the intermediate transferring member 70, a single-color toner image formed on the photoconductor 20. When toner images of four colors are successively transferred in a superposed manner, a full-color toner image is formed on the intermediate transferring member 70. The intermediate transferring member 70 is a layered endless belt made by providing an aluminum vapor deposition layer on the surface of a PET film and forming a semiconductive coating on the surface. The intermediate transferring member 70 is driven to rotate at substantially the same circumferential speed as the photoconductor 20. The second transferring unit 80 is a device for transferring the single-color toner image or the full-color toner image formed on the intermediate transferring member 70 onto a medium such as paper, film, and cloth.

The fusing unit 90 is a device for fusing the single-color toner image or the full-color toner image, which has been transferred to the medium, onto the medium to turn it into a permanent image. The cleaning unit 75 is a device that is provided between the first transferring unit 60 and the charging unit 30, has a rubber cleaning blade 76 abutting against the surface of the photoconductor 20, and is for removing the toner T remaining on the photoconductor 20 by scraping it off with the cleaning blade 76 after the toner image has been transferred onto the intermediate transferring member 70 by the first transferring unit 60.

Figure 2:
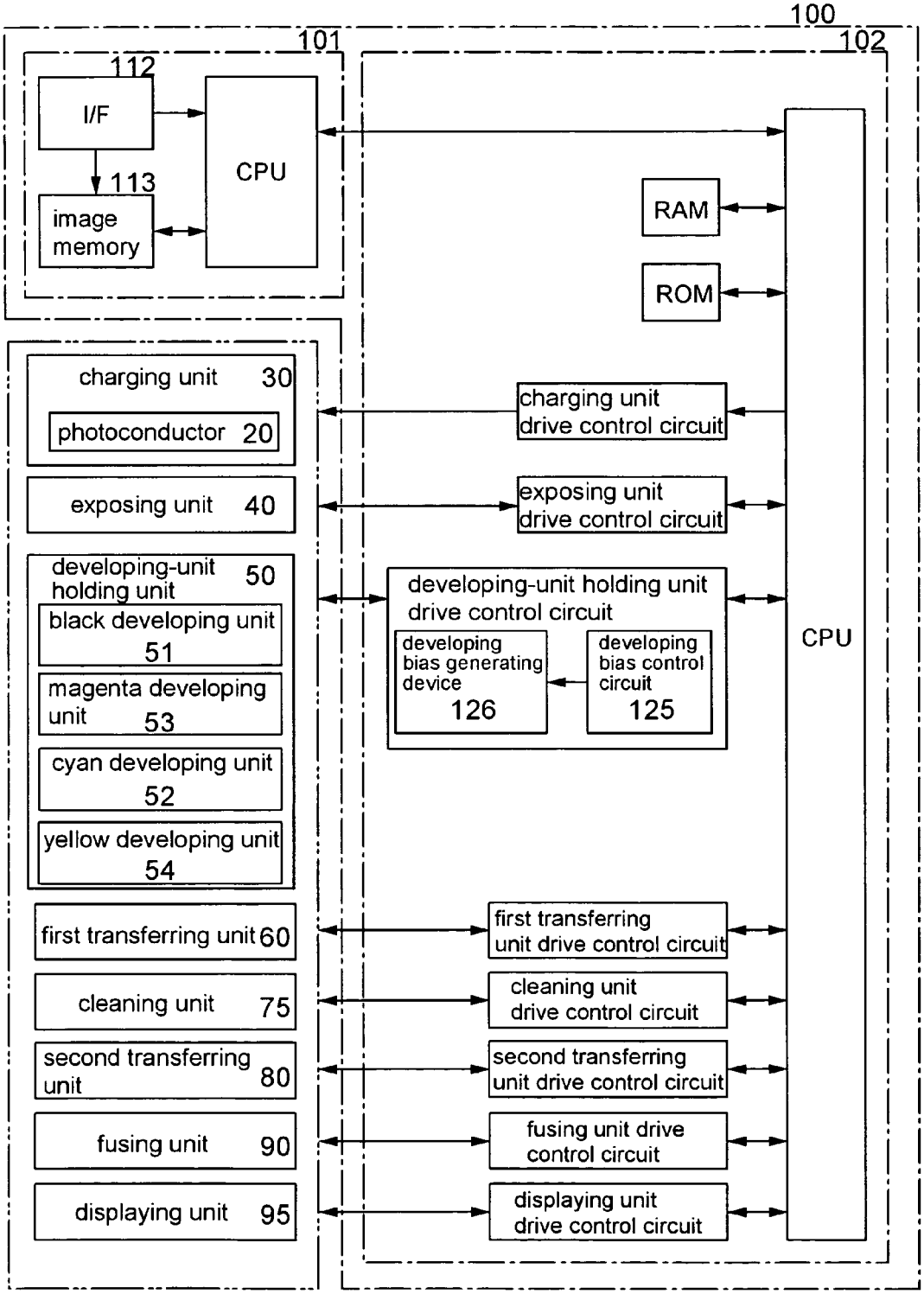
FIG. 2 is a block diagram showing a control unit 100.

The control unit 100 includes a controller section 101 and a unit controller 102 as shown in FIG. 2. Image signals and control signals are input to the controller section 101, and according to instructions based on these image signals and control signals, the unit controller 102 controls each of the above-mentioned units to form an image.

Next, the operation of the printer 10 configured as above is described.

When image signals and control signals are input from a not-shown host computer to the controller section 101 of the printer 10 through an interface (I/F) 112, then the photoconductor 20, a developing roller and the intermediate transferring member 70 rotate under the control of the unit controller 102 according to the instructions from the controller section 101. While being rotated, the photoconductor 20 is successively charged by the charging unit 30 at the charging position.

With the rotation of the photoconductor 20, the charged area of the photoconductor 20 reaches an exposing position. A latent image that corresponds to the image information for the first color, for example, yellow Y, is formed in that area by the exposing unit 40. The developing-unit holding unit 50 positions the yellow developing unit 54, which contains yellow (Y) toner, at the developing position opposing the photoconductor 20. With the rotation of the photoconductor 20, the latent image formed on the photoconductor 20 reaches the developing position, and is developed with the yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring member 70 by the first transferring unit 60. At this time, a first transferring voltage, which has an opposite polarity to the polarity to which the toner T is charged, is applied to the first transferring unit 60. It should be noted that, during this process, the photoconductor 20 and the intermediate transferring member 70 are in contact, whereas the second transferring unit 80 is kept separated from the intermediate transferring member 70.

By sequentially repeating the above-mentioned processes with the developing units for the second, the third, and the fourth colors, toner images in four colors corresponding to the respective image signals are transferred to the intermediate transferring member 70 in a superimposed manner. Thus, a full color toner image is formed on the intermediate transferring member 70.

With the rotation of the intermediate transferring member 70, the full-color toner image formed on the intermediate transferring member 70 reaches a second transferring position, and is transferred onto the medium by the second transferring unit 80. It should be noted that the medium is carried from the paper supply tray 92 to the second transferring unit 80 via the paper-feed roller 94 and the resist rollers 96. During transferring operations, a second transferring voltage is applied to the second transferring unit 80, while the unit 80 is pressed against the intermediate transferring member 70.

The full-color toner image transferred onto the medium is heated and pressurized by the fusing unit 90 and fused to the medium. On the other hand, after the photoconductor 20 passes the first transferring position, the toner T adhering to the surface of the photoconductor 20 is scraped off by the cleaning blade 76 that is supported by the cleaning unit 75, and the photoconductor 20 is prepared for charging for the next latent image to be formed. The scraped-off toner T is collected into a remaining-toner collector of the cleaning unit 75.

Overview of the Control Unit

Next, a configuration of the control unit 100 is described with reference to FIG. 2. The controller section 101 of the control unit 100 is connected to a host computer via the interface 112, and is provided with an image memory 113 for storing the image signals that have been input from the host computer. The unit controller 102 is electrically connected to the units in the body of the apparatus (i.e., the charging unit 30, the exposing unit 40, the developing-unit holding unit 50, the first transferring unit 60, the cleaning unit 75, the second transferring unit 80, the fusing unit 90, and the displaying unit 95), and it detects the state of the units by receiving signals from sensors provided in those units, and controls them based on the signals that are input from the controller section 101.

Configuration Example of the Developing Unit

Figure 3:
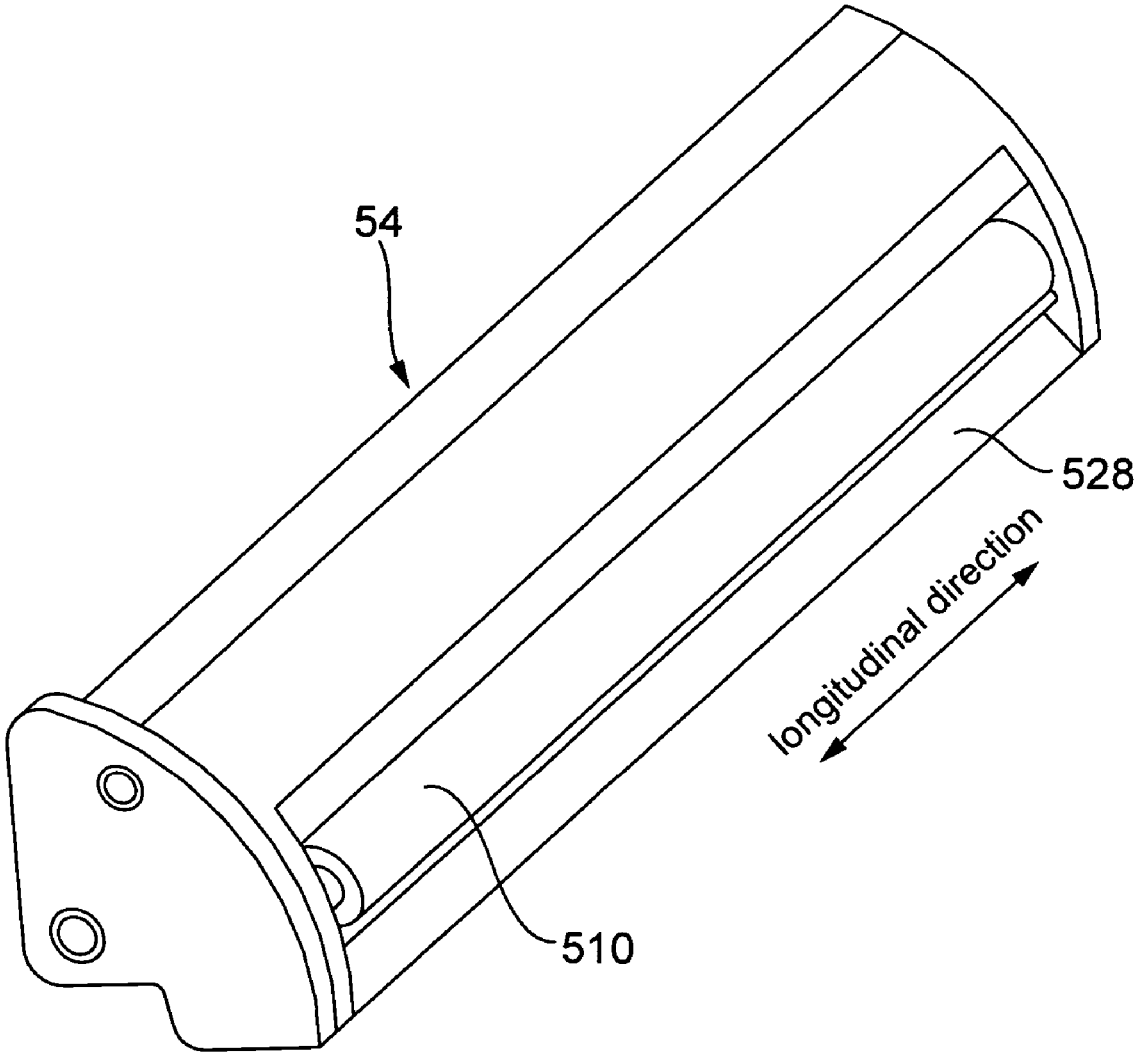
FIG. 3 is a conceptual diagram of a developing unit.
Figure 4:
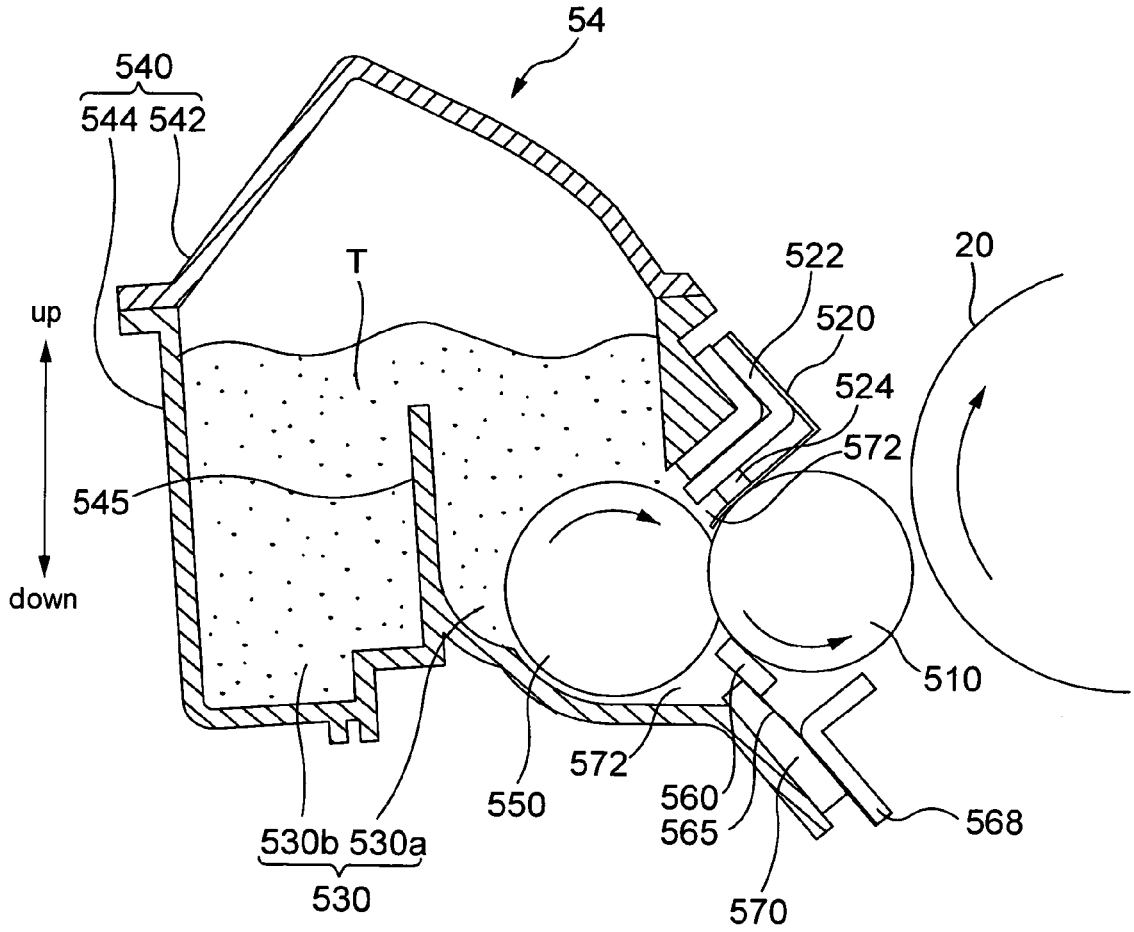
FIG. 4 is a sectional view showing main structural components of this developing unit.
Figure 5A:
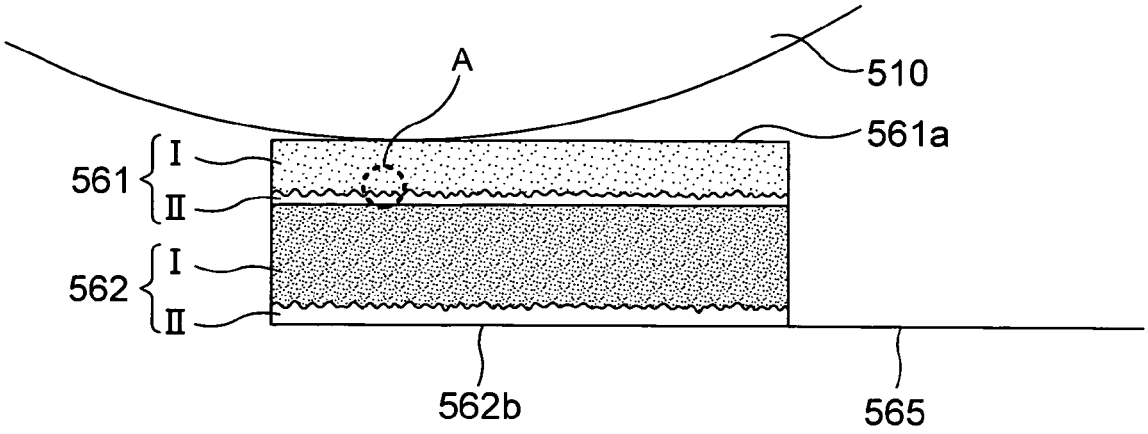
FIG. 5A is a schematic diagram of the vicinity of a regulating blade 560.
Figure 5B:
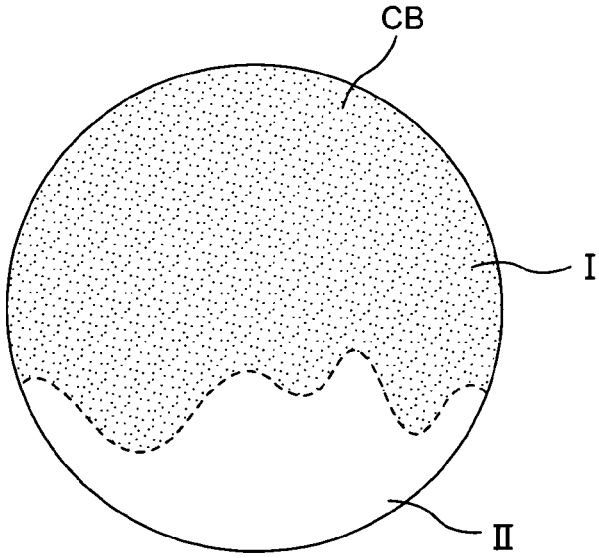
FIG. 5B is a schematic diagram of the boundary portion between a first layer 561 and a second layer 562 (corresponds to portion A in FIG. 5A).

Next, using FIG. 3, FIG. 4, FIG. 5A and FIG. 5B, an example of the configuration of a developing unit will be described. FIG. 3 is a conceptual diagram of a developing unit. FIG. 4 is a sectional view showing the main structural components of this developing unit. FIG. 5A is a schematic diagram of the vicinity of the regulating blade 560. FIG. 5B is a schematic diagram of the boundary portion between a first layer 561 and a second layer 562 (corresponds to portion A in FIG. 5A). It should be noted that the sectional view shown in FIG. 4 is a cross section of the developing unit bisected by a plane perpendicular to the longitudinal direction shown in FIG. 3. Further, in FIG. 4, the arrow indicates the vertical direction, as in FIG. 1, and, for example, the central axis of the developing roller 510 is located below the central axis of the photoconductor 20. Also, in FIG. 4, the yellow developing unit 54 is shown positioned at a developing position that is in opposition to the photoconductor 20.

The developing-unit holding unit 50 is provided with: the black developing unit 51 containing black (K) toner; the magenta developing unit 53 containing magenta (M) toner; the cyan developing unit 52 containing cyan (C) toner; and the yellow developing unit 54 containing yellow (Y) toner. Since the configuration of the developing units is the same, only the yellow developing unit 54 will be explained below.

The yellow developing unit 54 includes the developing roller 510, which is an example of a developer bearing member, a sealing member 520, a toner containing section 530, a housing 540, a toner supplying roller 550, and a regulating blade 560, which is an example of a charging member.

The developing roller 510 bears toner T and delivers it to the developing position opposite the photoconductor 20. The developing roller 510 is made of metal and, for example, is manufactured from aluminum alloy such as aluminum alloy 5056 or aluminum alloy 6063, or iron alloy such as STKM. The roller 510 is plated with, for example, nickel plating or chromium plating, as necessary.

Further, as shown in FIG. 3, the developing roller 510 is supported at both ends in its longitudinal direction and is rotatable about its central axis. As shown in FIG. 4, the developing roller 510 rotates in the opposite direction (counterclockwise in FIG. 4) to the rotation direction of the photoconductor 20 (clockwise in FIG. 4). The central axis of the roller 510 is located below the central axis of the photoconductor 20.

Further, as shown in FIG. 4, when the yellow developing unit 54 opposes the photoconductor 20, there is a gap between the developing roller 510 and the photoconductor 20. That is, the yellow developing unit 54 develops the latent image formed on the photoconductor 20 in a non-contacting state.

Moreover, when developing the latent image formed on the photoconductor 20, a developing bias generating device 126 (see FIG. 2) provided in a developing-unit holding unit driving control circuit applies a developing bias, which is a voltage that is obtained by superposing an AC voltage over a DC voltage, to the developing roller 510, forming an alternating electric field between the developing roller 510 and the photoconductor 20. That is to say, in the present embodiment, the latent image borne by the photoconductor 20 is developed using the jumping development technique. It should be noted that the developing-unit holding unit drive control circuit is provided with a developing bias control circuit 125 fulfilling the function of turning the developing bias on and off and setting a suitable developing bias value.

The sealing member 520 prevents the toner T in the yellow developing unit 54 from spilling out therefrom, and also collects the toner T, which is on the developing roller 510 that has passed the developing position, into the developing device without scraping it off. The sealing member 520 is a seal made of, for example, polyethylene film. The sealing member 520 is supported by a seal support metal plate 522, and is attached to the housing 540 via the seal support metal plate 522. A seal urging member 524 made of Moltoprene or the like is provided at the side of the sealing member 520 that is opposite from its developing roller 510 side, and due to the elasticity of the seal urging member 524, the sealing member 520 is pressed against the developing roller 510. It should be noted that the contact position where the sealing member 520 is placed in contact with the developing roller 510 is above the central axis of the developing roller 510.

The housing 540 is manufactured by welding together a plurality of integrally-molded housing sections, that is, an upper housing section 542 and a lower housing section 544. A toner containing section 530 for containing the toner T is formed inside the housing 540. The toner containing section 530 is divided by a partitioning wall 545 for partitioning the toner T, which protrudes inwards (in the vertical direction of FIG. 4) from the inner wall, into two toner containing sections 530, namely, a first toner containing section 530*a* and a second toner containing section 530*b*. The first toner containing section 530*a* and the second toner containing section 530*b* are in communication at the top, and in the state shown in FIG. 4, the movement of toner T is regulated by the partitioning wall 545.

However, when the developing-unit holding unit 50 rotates, the toner contained in the first toner containing section 530*a* and the second toner containing section 530*b* is temporarily collected on the side where the top sides (when at the developing position) are in communication, and when it returns to the state shown in FIG. 4, the toner is mixed and returned to the fist toner containing section 530*a* and the second toner containing section 530*b*. That is to say, by rotating the developing-unit holding unit 50, the toner T in the developing unit is suitably stirred.

Therefore, in the present embodiment, the toner containing section 530 is not provided with a stirring member, but it is also possible to provide a stirring member for stirring the toner T contained in the toner containing section 530. Moreover, as shown in FIG. 4, the housing 540 (that is, the first toner containing section 530*a*) has an aperture 572 at its lower side, and the developing roller 510 is arranged such that it faces this aperture 572.

The toner supplying roller 550 is provided in the first toner containing space 530*a* described above and supplies the toner T contained in the first toner containing space 530*a* to the developing roller 510. The toner supplying roller 550 strips off, from the developing roller 510, the toner T remaining on the developing roller 510 after developing. The toner supplying roller 550 is made of polyurethane foam, for example, and is in contact with the developing roller 510 in a state of elastic deformation.

The toner supplying roller 550 is disposed at a lower part of the first toner containing section 530*a*, and the toner T contained in the first toner containing section 530*a* is supplied to the developing roller 510 by the toner supplying roller 550 at the lower part of the first toner containing section 530*a*. The toner supplying roller 550 is rotatable about its central axis. The central axis of the toner supplying roller 550 is situated below the central axis of rotation of the developing roller 510. Also, the toner supplying roller 550 rotates in a direction (in FIG. 4, the clockwise direction) that is opposite from the direction of rotation of the developing roller 510 (in FIG. 4, the counterclockwise direction).

The regulating blade 560 charges the toner T by imparting charges to the toner T borne by the developing roller 510, and also regulates the thickness of the layer of the toner T borne by the developing roller 510. This regulating blade 560 is molded by centrifugal molding, in which the material of the regulating blade 560 is supplied into a hollow die having an inner wall and molding the regulating blade 560 by rotating the die. It should be noted that details of the centrifugal molding process are discussed later.

Also, a conductive agent is dispersed in the polymer elastic member E forming the base matrix of the regulating blade 560, so that the regulating blade 560 is conductive. Examples of materials for the polymer elastic member E include elastomers, polyurethane, silicone rubber and other rubber materials. Moreover, in the present embodiment, carbon black CB (represented by the black dots in FIG. 5A and FIG. 5B) is used as the conductive agent.

Moreover, the regulating blade 560 abuts against the developing roller 510, and is provided with a first layer 561 containing carbon black CB and a second layer 562 containing carbon black CB and positioned on the side opposite from the developing roller 510, with respect to the first layer 561. It should be noted that the same polymer elastic member E is used for the base matrix of the first layer 561 and the base matrix of the second layer 562.

Here, the density of the carbon black CB contained in the second layer 562 is higher than the density of the carbon black CB contained in the first layer 561. The higher the density of carbon black CB is, the smaller is the resistance of the first layer 561 and the second layer 562. Therefore, in the present embodiment, the resistance of the first layer 561 is for example $1.0\times10^7$ (Ω), and the resistance of the second layer 562 is for example $1.0\times10^5$ (Ω).

Moreover, the first layer 561 also contains an ionic conductive agent (not shown in the figures) within the polymer elastic member E, in addition to carbon black CB. On the other hand, the second layer 562 does not include an ionic conductive agent. Examples of the ionic conductive agent include tetraethyl ammonium, tetrabutyl ammonium and the like.

Moreover, the thickness of the first layer 561 is smaller than the thickness of the second layer 562, and in the present embodiment, the thickness of the first layer 561 is 0.5 (mm), whereas the thickness of the second layer 562 is 1.5 (mm).

The regulating blade 560 (second layer air surface 562*b* (explained below)) is supported by a blade-supporting thin plate 565 made of metal. This blade-supporting thin plate 565 is an elastic thin board made of phosphor bronze or stainless steel or the like. The blade-supporting thin plate 565 is supported at one end by a supporting metal plate 568, and is attached to the housing 540 through this supporting metal plate 568. Also, a blade backing member 570 made of Moltoprene or the like is provided on the side of the regulating blade 560 that is opposite from its developing roller 510 side.

Here, the regulating blade 560 is pressed against the developing roller 510 by the elasticity due to the flexure of the blade-supporting thin plate 565. Moreover, the blade backing member 570 prevents the toner T from entering in between the blade-supporting thin plate 565 and the housing 540, and thus stabilizes the elasticity due to the flexure of the blade-supporting thin plate 565, and presses the regulating blade 560 against the developing roller 510 by applying force to the regulating blade 560 toward the developing roller 510 from directly behind the regulating blade 560. Consequently, the blade backing member 570 increases the uniform contact of the regulating blade 560 with the developing roller 510.

The end of the regulating blade 560 (first layer 561) on the side opposite from the side supported by the blade support metal plate 568, that is, its tip, is not in contact with the developing roller 510, and the portion away from its tip by a predetermined distance is in contact with the developing roller 510 over a certain width. That is, the regulating blade 560 (first layer 561) is not in contact with the developing roller 510 at its edge but rather at its mid section. Also, the regulating blade 560 is disposed such that its tip faces upstream in the direction in which the developing roller 510 rotates, and it is in so-called counter contact. It should be noted that the contact position where the regulating blade 560 (first layer 561) is placed in contact with the developing roller 510 is lower than the central axis of the developing roller 510 and is lower than the central axis of the toner supplying roller 550.

Furthermore, a voltage is applied to the regulating blade 560 from the developing bias generating device 126 (see FIG. 2) via the blade supporting thin plate 565, such that the potential of the regulating blade 560 becomes the same as the potential of the developing roller 510.

In the yellow developing unit 54 configured in this manner, the toner supplying roller 550 supplies the toner T contained in the toner containing section 530 to the developing roller 510. The toner T that has been supplied to the developing roller 510 is brought to the contact position of the regulating blade 560 in conjunction with the rotation of the developing roller 510, and when it passes the contact position, the thickness of the toner T layer is regulated while a charge is being imparted to it. The toner T on the charged developing roller 510 is brought to the developing position in opposition to the photoconductor 20 due to further rotation of the developing roller 510, and is used for developing the latent image formed on the photoconductor 20 in an alternating electric field at the developing position. The toner T on the developing roller 510 that has passed the developing position due to further rotation of the developing roller 510 passes the sealing member 520 and is collected into the developing device by the sealing member 520 without being scraped off. Moreover, the toner T that is still remaining on the developing roller 510 can be stripped off by the toner supplying roller 550.

Manufacturing Example of Regulating Blade 560

As noted above, the regulating blade 560 is made by centrifugal molding, in which the material of the regulating blade 560 (base matrix, conductive agent, etc.) is supplied into a hollow die having an inner wall and rotating the die to mold the regulating blade 560. Here, the regulating blade 560 has a first layer 561 and a second layer 562, so that when molding the regulating blade 560 by centrifugal molding, the material of the first layer 561 is supplied into the die and the die is rotated, and then the material of the second layer 562 is supplied into the die and the die is rotated. The following is a description of an example of manufacturing the regulating blade 560 by centrifugal molding.

Figure 6:
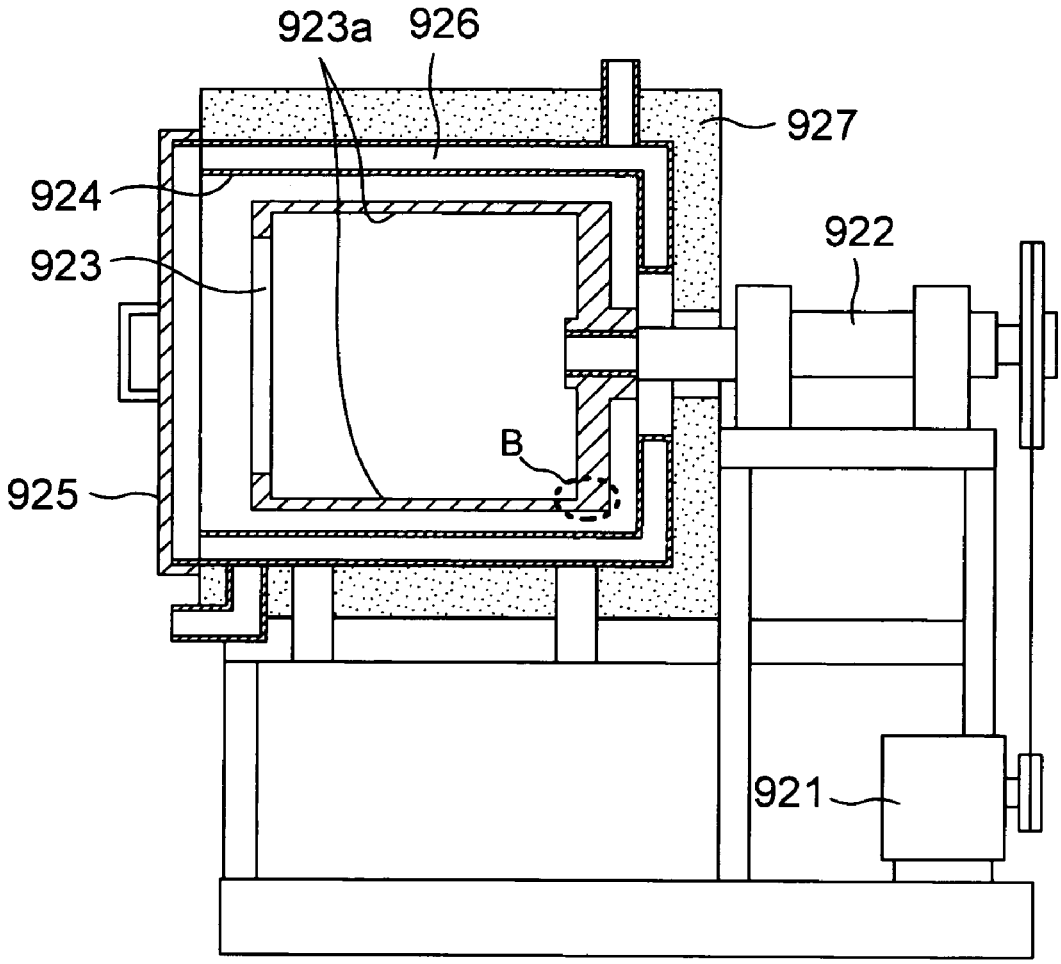
FIG. 6 is a diagram showing an example of a centrifugal molding machine, which is the device with which the regulating blade 560 is manufactured.

First, the centrifugal molding machine used for centrifugal molding is explained with reference to FIG. 6. FIG. 6 is a diagram showing an example of a centrifugal molding machine, which is the device with which the regulating blade 560 is manufactured. As shown in FIG. 6, this centrifugal molding machine has a cylindrical die 923 having a bottom portion whose center is fixed to one end of a rotating shaft 922 that is rotatively driven by a motor 921. It should be noted that the surface of the inner wall 923*a* of the cylindrical die 923 has been turned into a specular surface by polishing or the like. Moreover, the cylindrical die 923 is held inside a box-shaped heating jacket 924. An aperture in this heating jacket 924 can be closed with a lid 925. Furthermore, the outer circumference of the heating jacket 924 is provided with a heating duct 926 for letting a heating fluid flow through it, and its outer side is covered by a heat-retaining layer 927. It should be noted that this cylindrical die 923 is an example of a "hollow die".

Figure 7A:
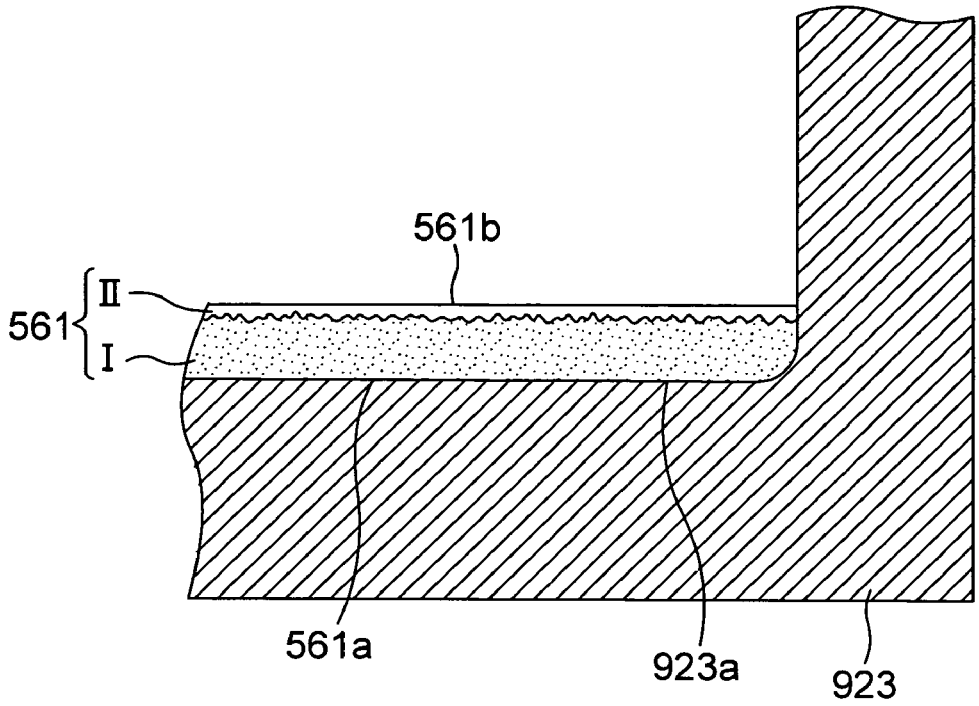
FIG. 7A is a schematic diagram showing a state in which the first layer has been molded.
Figure 7B:
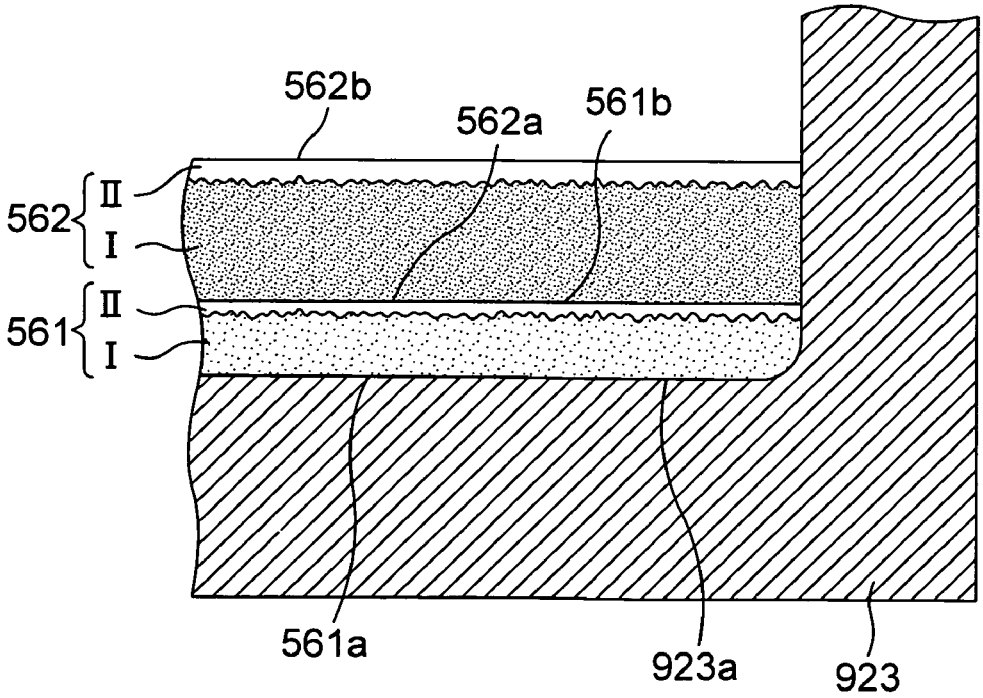
FIG. 7B is a schematic diagram showing a state in which the first layer and the second layer have been molded.

Next, an example of manufacturing the regulating blade 560 with this centrifugal molding machine is described with reference to FIG. 7A and FIG. 7B. FIG. 7A is a schematic diagram showing the state in which the first layer 561 has been molded. FIG. 7B is a schematic diagram showing the state in which the first layer 561 and the second layer 562 have been molded. It should be noted that FIG. 7A and FIG. 7B are diagrams showing magnifications of region B in FIG. 6.

First, as shown in FIG. 7A, the first layer 561 is molded. More specifically, the material for the first layer 561 (i.e. a mixture of a polymer elastic member, carbon black CB and an ionic conductive agent) is supplied into the cylindrical die 923, and the cylindrical die 923 is rotated. Then, after the material of the first layer 561 has spread over the surface of the inner wall 923*a*, the material is cured. Thus, a cylindrical first layer 561 is formed along the surface of the inner wall 923*a*.

It should be noted that when the first layer 561 is formed, the following phenomenon occurs: Due to the centrifugal force when rotating the cylindrical die 923, the carbon black CB moves towards the side of the surface of the inner wall 923*a* of the cylindrical die 923. Therefore, the distribution density of carbon black CB increases gradually toward the die-opposing surface 561*a* that is formed in opposition to the surface of the inner wall 923*a* of the cylindrical die 923, and the distribution density is sufficiently low or no carbon black CB is present at all on the side of the first layer air surface 561*b* on the side opposite from the die-opposing surface 561*a*. In the following, the portion on the side of the die-opposing surface 561*a* where the distribution density of carbon black CB is large is referred to for convenience as "dense portion I", whereas the portion on the side of the first layer air surface 561*b* where the distribution density of carbon black CB is low or where there is no carbon black CB present at all is referred to as "non-dense portion II".

On the other hand, the ionic conductive agent is dispersed more uniformly than the carbon black CB and is also present in the non-dense portion II. As noted above, the surface of the inner wall 923*a* is a specular surface, so that the die-opposing surface 561*a* becomes smooth.

Next, after the first layer 561 has been cured, the second layer 562 is formed on the inner side of the first layer 561, as shown in FIG. 7B. More specifically, the material for the second layer 562 (i.e. a mixture of a polymer elastic member and carbon black CB) is supplied into the cylindrical die 923, and the cylindrical die 923 is rotated. Then, after the material of the second layer 562 has spread over the first layer air surface 561*b*, the material is cured. Thus, the first layer 561 and the second layer 562 are formed along the surface of the inner wall 923*a*. Here, a predetermined amount of carbon black is supplied into the cylindrical die 923, such that the density of the carbon black included in the second layer 562 is larger than the density of the carbon black included in the first layer 561.

It should be noted that when the second layer 562 is formed, the following phenomenon occurs: Due to the centrifugal force when rotating the cylindrical die 923, the carbon black CB moves towards the first layer air face 561*b*. Therefore, the distribution density of carbon black CB increases gradually toward the contact surface 562*a* which is in contact with the first layer air surface 561*b*, and the distribution density is sufficiently low or no carbon black CB is present at all on the side of the second layer air surface 562*b* on the side opposite from the contact surface 562*a*. In the following, as in the case of the first layer 561, the portion on the side of the contact surface 562*a* where the distribution density of carbon black CB is large is referred to for convenience as "dense portion I", whereas the portion on the side of the second layer air surface 562*b* where the distribution density of carbon black CB is low or where there is no carbon black CB present at all is referred to as "non-dense portion II".

Next, after stopping the rotation of the cylindrical die 923, the cylindrical first layer 561 and second layer 562 are taken out and cut into sheet-shaped pieces. Then, the sheet-shaped first layer 561 and second layer 562 are cut into the desired size, thus obtaining the regulating blade 560. It should be noted that it is possible to control the thickness of the first layer 561 and the second layer 562 through the amount of material that is supplied into the cylindrical die 923.

The following is an additional explanation about the above-mentioned dense portion I and the non-dense portion II. In the first layer 561 and the second layer 562, the thickness of the non-dense portion II is sufficiently smaller than the thickness of the dense portion I, for example, the thickness of the non-dense portion II of the first layer 561 may be about 100 (μm). Also, the thickness of the non-dense portion II of the first layer 561 is smaller than the thickness of the non-dense portion II of the second layer 562. At the boundary between the dense portion I and the non-dense portion II (see the boundary drawn as a wavy line in FIG. 5A etc.), the carbon black CB is distributed non-uniformly (see FIG. 5B).

It should be noted that in this embodiment, the die-opposing surface 561*a* of the dense portion I of the first layer 561 is placed in contact with the developing roller 510.

And, in this embodiment, the surface on the side proximate to the inner wall 923*a*, that is, the die-opposing surface 561*a*, is placed in contact with the developing roller 510.

Function of the Regulating Blade 560 Provided with the First Layer 561 and the Second Layer 562

As explained above, the regulating blade 560, which is placed in contact with the developing roller 510, comprises a first layer 561 and a second layer 562. The first layer 561 includes a conductive agent (for example carbon black CB). The second layer 562 is positioned on the opposite side of the developing roller 510, with respect to the first layer 561, and includes the conductive agent at a greater density than the first layer 561. Thus, it is possible to suppress the occurrence of fogging. This is described in greater detail below.

The regulating blade 560 includes the conductive agent in order to be conductive. Furthermore, it is necessary for a sufficient amount of conductive agent in total to be dispersed throughout the regulating blade 560 in order to charge the toner T borne by the developing roller 510 to the desired charge amount.

On the other hand, when looking at the portion where the regulating blade 560 is in contact with the developing roller 510, it can be seen that, as use of the developing units 51, 52, 53 and 54 advances, the surface abutting the developing roller 510 is gradually worn off due, for example, to friction caused by the rotation of the developing roller 510, thus exposing the conductive agent. This promotes a lowering of the charge amount of the toner T, due to contact between the toner T and the exposed conductive agent. And when the charge amount of the toner T borne by the developing roller 510 is lowered too much, then low-charge-amount toner T that should not be borne by the photoconductor 20 will be borne by the photoconductor 20, and as a result there is a possibility that fogging occurs. Furthermore, when fogging occurs, then this may lead to a decrease in image quality.

As shown in FIG. 5A, the regulating blade 560 according to the present embodiment is provided with a first layer 561 that is placed in contact with the developing roller 510 and a second layer 562 that is positioned on the side opposite from the developing roller 510, with respect to the first layer 561. Moreover, the density of the conductive agent contained in the first layer 561 is lower than the density of the conductive agent contained in the second layer 562.

In this way, since the regulating blade 560 is divided into two layers, namely the first layer 561 and the second layer 562, and the density of the conductive agent contained in the first layer 561 which is placed in contact with the developing roller 510 is low, the possibility that the conductive agent is exposed is decreased, even when the surface of the first layer 561 contacting the developing roller 510 is worn off. Therefore, in the present embodiment, it is possible to suppress a decrease in the charge amount of the toner T due to exposed conductive agent. On the other hand, since only the density of the conductive agent contained in the first layer 561 is low, it becomes possible to ensure a sufficient amount of conductive agent as a whole.

Thus, if the regulating blade 560 includes the above-described first layer 561 and second layer 562, it is possible to ensure a sufficient amount of conductive agent as a whole while being able to appropriately charge the toner T borne by the developing roller 510. Therefore, it is possible to prevent occurrence of a situation in which low-charge-amount toner T, which should not be borne by the photoconductor 20, is borne by the photoconductor 20, and as a result, it is possible to suppress the occurrence of fogging.

Effect of Placing the Die-Opposing Surface 561*a* in Contact with the Developing Roller 510

As pointed out above, the regulating blade 560, which includes the conductive agent, is molded by centrifugal molding, in which the material of the regulating blade 560 (base matrix, conductive agent, etc.) is supplied into the cylindrical die 923 with the inner wall 923*a*, and the cylindrical die 923 is rotated to mold the regulating blade 560. Further, the surface on the side proximate to the inner wall 923*a* (die-opposing surface 561*a*) is placed in contact with the developing roller 510. Thus, it is possible to suppress the occurrence of stripes. This is described in greater detail below.

The regulating blade 560 is made by centrifugal molding, that is, by a molding method in which the material of the regulating blade 560 (base matrix, conductive agent, etc.) is supplied into a cylindrical die 923 having an inner wall 923*a* and the cylindrical die 923 is rotated to form the regulating blade 560. Due to the centrifugal force acting when molding by centrifugal molding, a dense portion I on the side proximate to the inner wall 923*a* in which the conductive agent is dispersed and a non-dense portion II on the side distant from the inner wall 923*a* in which there is almost no conductive agent are formed in this regulating blade 560. Moreover, at the boundary between the dense portion I and the non-dense portion II, the conductive agent is dispersed non-uniformly.

Conventionally, the surface on the side of the non-dense portion II of the regulating blade 560 molded in this manner has been placed in contact with the developing roller 510. In this case, the toner T is charged non-uniformly, and there is a possibility that stripes appear in the toner image formed on the photoconductor 20.

Figure 8:
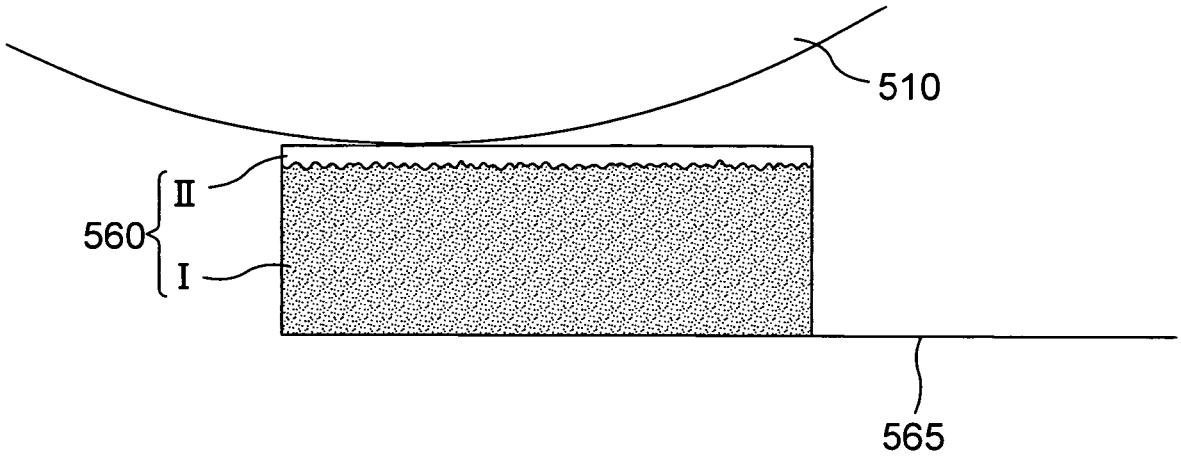
FIG. 8 is a diagram illustrating a comparative example.

This is explained more specifically with reference to a comparative example shown in FIG. 8. With the regulating blade 560 shown in FIG. 8, the surface on the side that is distant from the inner wall 923*a* is placed in contact with the developing roller 510. Moreover, the boundary between the non-dense portion II and the dense portion I is positioned close to this surface (the distance between this surface and the boundary is about 100 μm). At this boundary, the resistance of the regulating blade 560 varies, because the conductive agent is dispersed non-uniformly, as noted above. The toner T that is borne by the developing roller 510 is thus charged non-uniformly due to the variations of the resistance of the regulating blade 560. In this case, when using a toner T that has been charged non-uniformly, there is a possibility that stripes appear in the toner image formed on the photoconductor 20. Furthermore, if there are stripes in the toner image, there will also be stripes in the image formed on paper, which leads to a decrease in image quality. It should be noted that FIG. 8 is a diagram illustrating a comparative example.

On the other hand, in the present embodiment, the surface of the regulating blade 560 formed by centrifugal molding that is on the side proximate to the inner wall 923*a* (for example the die-opposing surface 561*a*) is placed in contact with the developing roller 510, as shown in FIG. 5A. Near this die-opposing surface 561*a*, the conductive agent is dispersed uniformly. Moreover, compared to the boundary of the comparative example, the boundary between the dense portion I and the non-dense portion II is further away from the developing roller 510, so that there is little influence due to the non-uniform dispersion of the conductive agent at the contact position of the regulating blade 560. Therefore, if the die-opposing surface 561*a* is placed in contact with the developing roller 510, the regulating blade 560 can appropriately charge the toner T borne by the developing roller 510 so that the occurrence of stripes can be suppressed.

Figure 9:
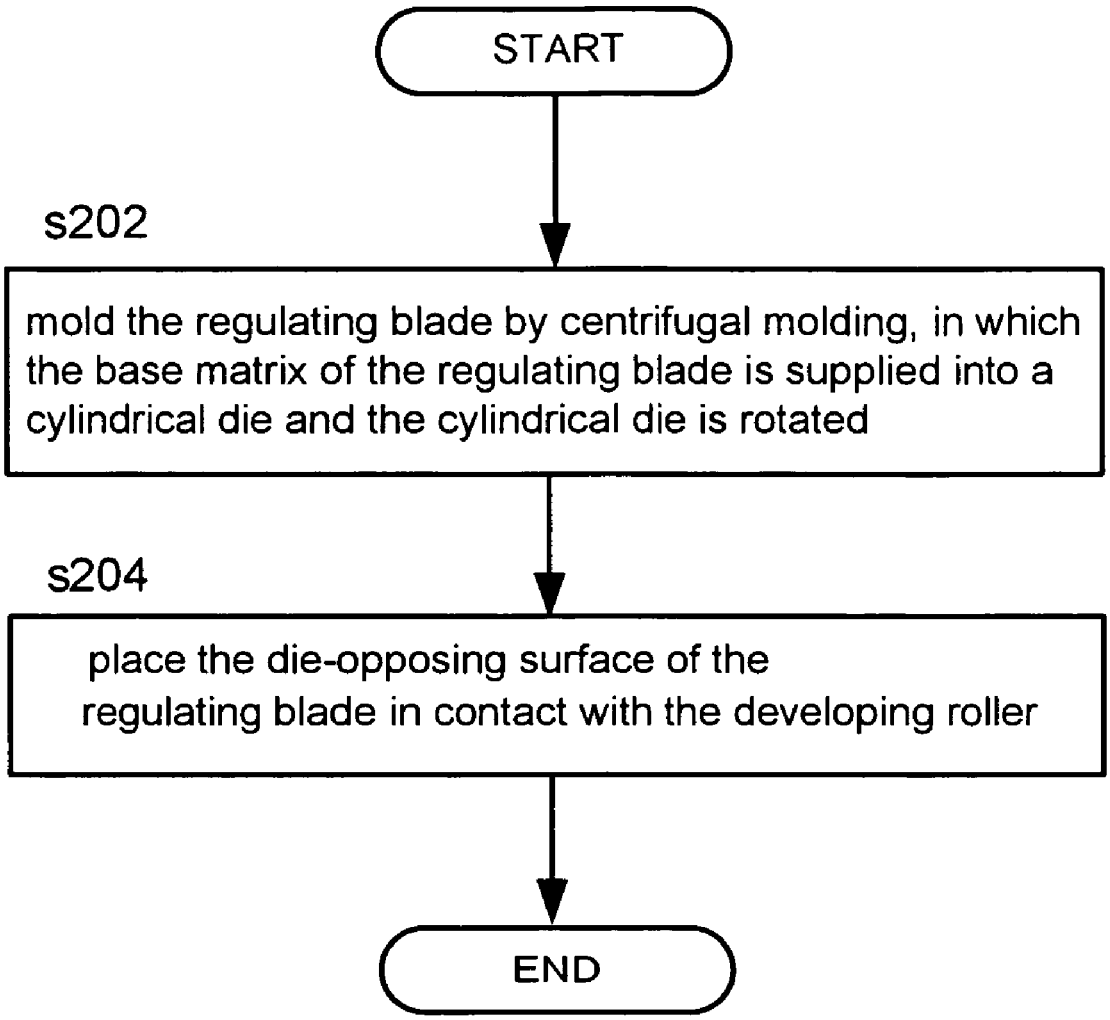
FIG. 9 is a flowchart for illustrating the manufacturing method of the developing units 51, 52, 53 and 54.

Moreover, it is possible to suppress the occurrence of stripes if, when manufacturing the developing units 51, 52, 53 and 54, the regulating blade 560 is molded by the process shown in FIG. 9, that is, by centrifugal molding, in which the material of the regulating blade 560 (polymer elastic member E, carbon black CB, etc.) is supplied into the cylindrical die 923, and the cylindrical die 923 is rotated to form the regulating blade 560 (Step s202), and the surface of the regulating blade 560 that is on the side proximate to the inner wall 923*a* (die-opposing surface 561*a*) is brought into contact with the developing roller (Step s204). FIG. 9 is a flowchart for illustrating the manufacturing method of the developing units 51, 52, 53 and 54.

Other Embodiments

An image forming apparatus, for example, according to an embodiment of the present invention is described above, but the foregoing embodiment of the invention is for the purpose of elucidating the present invention and is not to be interpreted as limiting the present invention. The invention can of course be altered and improved without departing from the gist thereof and includes equivalents.

The present invention relates to developing units 51, 52, 53 and 54 (developing devices) comprising: a developing roller 510 (developer bearing member) for bearing toner T (developer); and a regulating blade 560 (charging member) for charging the toner T borne by the developing roller 510, the regulating blade 560 having a first layer 561 containing a conductive agent and placed in contact with the developing roller 510, and a second layer 562 that is positioned on the side opposite from the developing roller 510, with respect to the first layer 561, and which contains a conductive agent at a density that is higher than that of the conductive agent contained in the fist layer 561.

Furthermore, the present invention also relates to developing units 51, 52, 53 and 54 (developing devices) comprising: a developing roller 510 (developer bearing member) for bearing toner T (developer); and a regulating blade 560 (charging member) for charging the toner T borne by the developing roller 510, the regulating blade 560 made by centrifugal molding, in which the material of the regulating blade 560 is supplied into a cylindrical die 923 (hollow die) having an inner wall 923*a* and the cylindrical die 923 is rotated to mold the regulating blade 560, wherein the surface of the regulating blade 560 on the side proximate to the inner wall 923*a* (for example the die-opposing surface 561*a*) is placed in contact with the developing roller 510.

It should be noted that in the foregoing embodiment, an intermediate transfer type full-color laser beam printer was described as an example of the image forming apparatus, but the present invention can also be adopted for various other types of image forming apparatuses, such as full-color laser beam printers that are not of the intermediate transfer type, monochrome laser beam printers, copying machines, and facsimiles.

Also, in the above-described embodiment, an image forming apparatus provided with developing units in a rotary arrangement was explained as an example, but there is no limitation to this. For example, it is also possible to apply the present invention to image forming apparatuses provided with developing units in a tandem arrangement.

Also, in the above-described embodiment, the photoconductor serving as the image bearing member was explained to have a configuration in which a photoconductive layer is provided on the outer circumferential surface of a cylindrical conductive base, but there is no limitation to this. For example, it may also be a so-called photoconductive belt configured by providing the photoconductive layer on the surface of a belt-shaped conductive base.

Also, in the above-describe embodiment, it was stated that the developer bearing member is a developing roller 510 made of metal, but there is no limitation to this. For example, the developer bearing member may also be a developing belt made of a belt-shaped resin base.

Furthermore, in the above-described embodiment, it was stated that the regulating blade 560 is made by centrifugal molding, in which the material of the regulating blade 560 (base matrix, etc.) is supplied into a cylindrical die 923 (hollow die) having an inner wall 923*a*, and the cylindrical die 923 is rotated to form the regulating blade 560, as shown in FIG. 6, but there is no limitation to this. For example, it is also possible to mold the regulating blade 560 by a process other than centrifugal molding.

However, if the regulating blade 560 is molded by centrifugal molding, then it is easy to obtain the regulating blade 560. For this reason, the above-described embodiment is preferable.

Moreover, in the above-described embodiment, a polymer elastic member is used as the base matrix of the regulating blade 560, but it is also possible to use a flexible material. Suitable examples of such a flexible material include polyamide, polyethylene terephthalate and other organic materials.

Furthermore, in the above-described embodiment, it was stated that to mold the regulating blade 560 by centrifugal molding, the material of the first layer 561 (mixture of polymer elastic member, carbon black, and ionic conductive agent) is supplied into the cylindrical die 923, the cylindrical die 923 is rotated (to mold the first layer 561), and then the material of the second layer 562 (mixture of polymer elastic member and carbon black) is supplied into the cylindrical die 923 and the cylindrical die 923 is rotated (to mold the second layer 562) as shown in FIGS. 7A and 7B. In this case, the die-opposing surface 561*a* of the first layer 561 is placed in contact with the developing roller 510, as shown in FIG. 5A. In the following, a regulating blade 560 molded in this manner is also referred to as "regulating blade 560 of the first embodiment".

Figure 10:
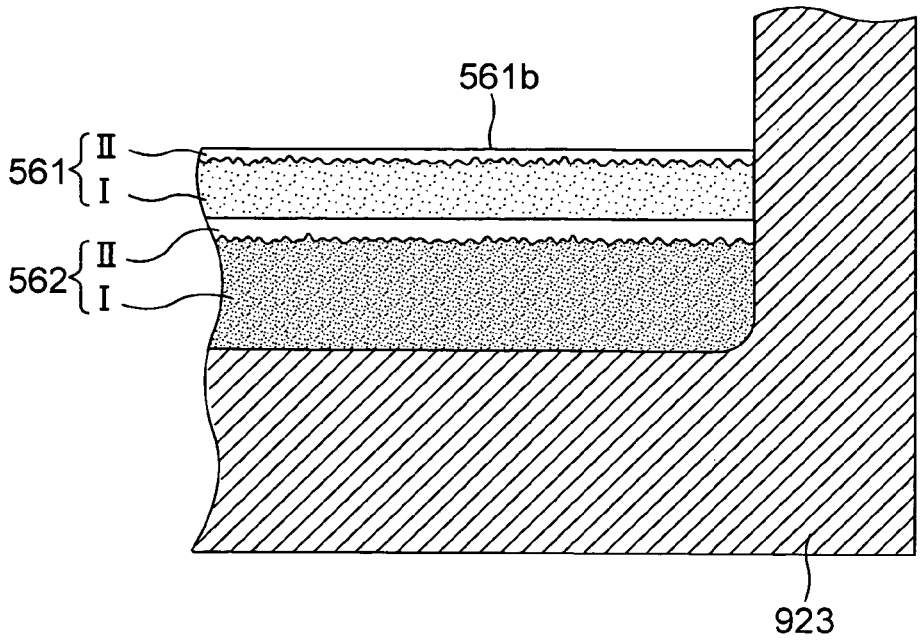
FIG. 10 shows the state in which a regulating blade 560 of a second embodiment has been formed.
Figure 11:
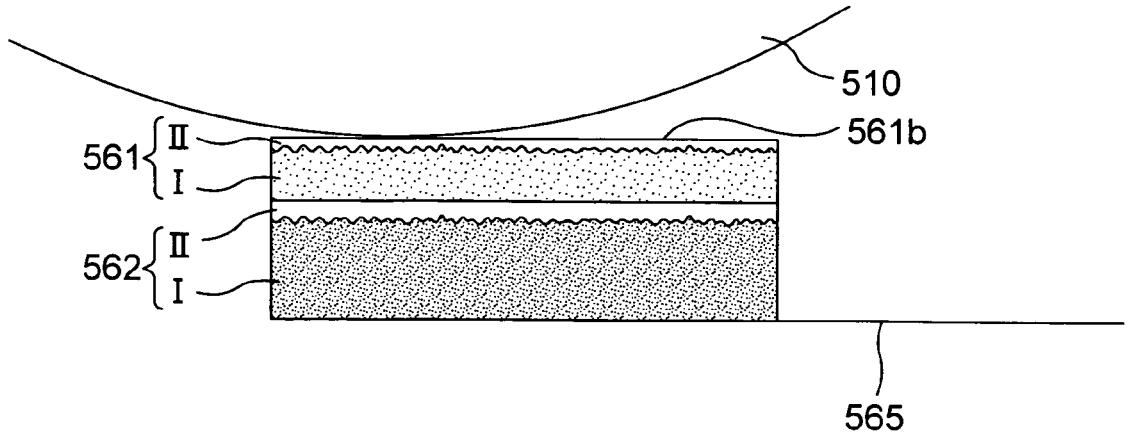
FIG. 11 shows the state in which the regulating blade 560 of the second embodiment shown in FIG. 10 is placed in contact with the developing roller 510.

However, there is no limitation to this. For example, as shown in FIG. 10, it is also possible to supply the material of the second layer 562 into the cylindrical die 923, rotate the cylindrical die 923, and then supply the material of the first layer 561 into the cylindrical die 923 and rotate the cylindrical die 923 to mold the regulating blade 560 by centrifugal molding. In this case, the first layer air surface 561*b* on the non-dense portion II side of the first layer 561 will be placed in contact with the developing roller 510, as shown in FIG. 11. It should be noted that FIG. 10 shows the state in which the regulating blade 560 of this second embodiment has been formed. FIG. 11 shows the state in which the regulating blade 560 of the second embodiment shown in FIG. 10 is placed in contact with the developing roller 510.

However, if the conductive agent is dispersed non-uniformly, then the resistance of the regulating blade 560 will also become non-uniform. If the conductive agent is dispersed non-uniformly on the side of the surface contacting the developing roller 510, then the charge amount of the toner T tends to become non-uniform due to variations in the resistance near this surface. In this case, when using a toner T that has been charged non-uniformly, there is a possibility that stripes (along the rotation direction of the photoconductor 20) appear in the toner image formed on the photoconductor 20. On the other hand, near the die-opposing surface 561*a*, the conductive agent is dispersed uniformly. Therefore, by using the regulating blade 560 of the first embodiment whose die-opposing surface 561*a* is placed in contact with the developing roller 510, the regulating blade 560 can appropriately charge the toner T borne by the developing roller 510, so that the occurrence of stripes can be suppressed. For this reason, the above-described embodiment is preferable.

Figure 12:
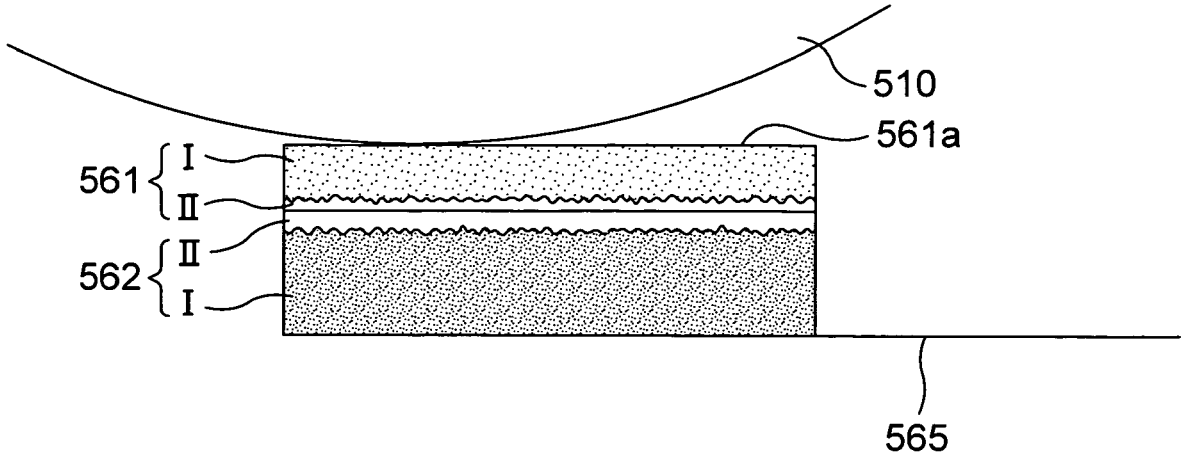
FIG. 12 shows a regulating blade 560 of a third embodiment.

Moreover, as shown in FIG. 12, it is also possible to form the first layer 561 and the second layer 562 separately by centrifugal molding, and to glue the first layer 561 and the second layer 562 together. FIG. 12 shows a regulating blade 560 of such a third embodiment.

Figure 13:
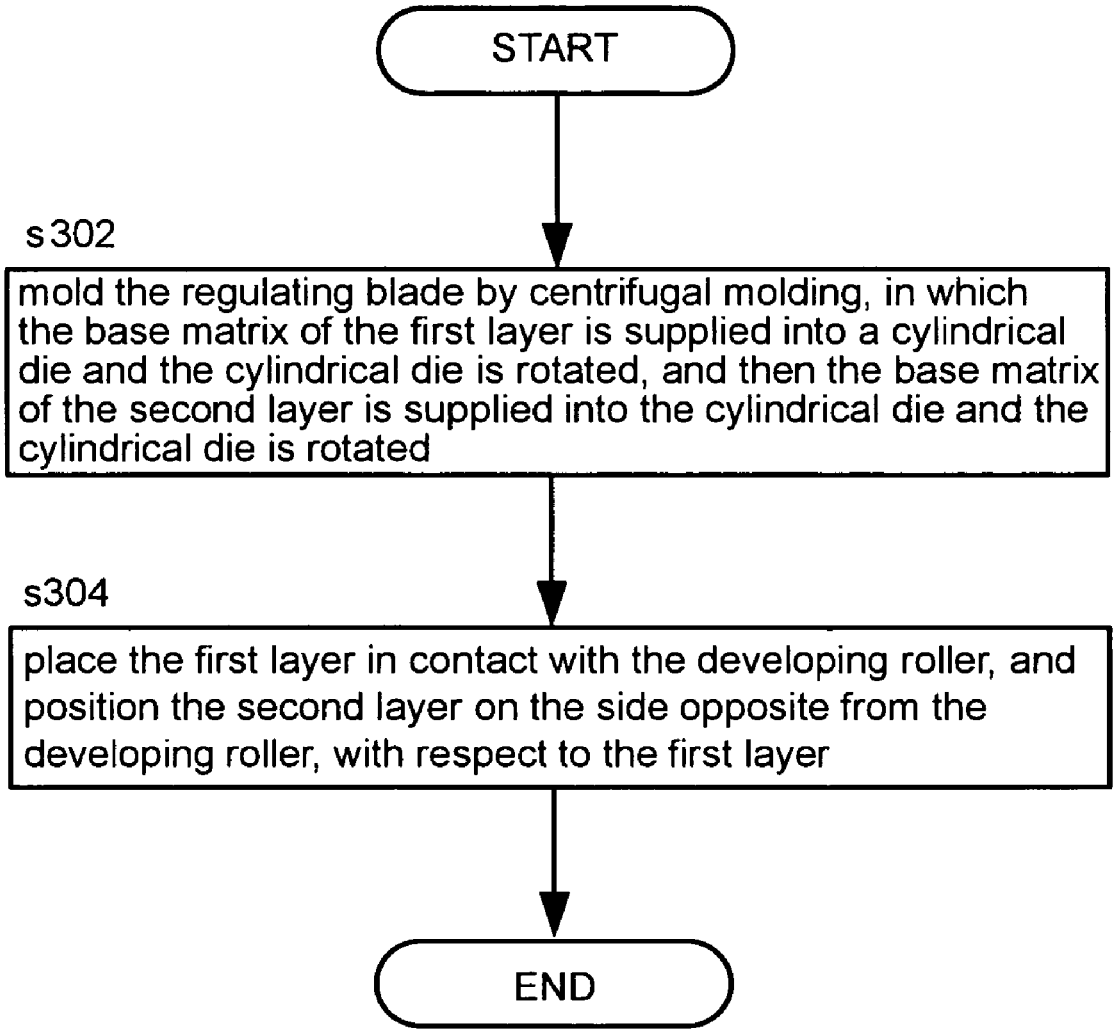
FIG. 13 is a flowchart for illustrating the manufacturing method of the developing units 51, 52, 53 and 54.

Moreover, when manufacturing the developing units 51, 52, 53 and 54, the regulating blade 560 may be molded by the process shown in FIG. 13, that is, by centrifugal molding, in which the material of the first layer 561 is supplied into the cylindrical die 923 and the cylindrical die 923 is rotated, and then the material of the second layer 562 is supplied into the cylindrical die 923 and the cylindrical die 923 is rotated (Step s302), and the first layer 561 of the regulating blade 560 molded by this centrifugal molding is brought into contact with the developing roller 510 and the second layer 562 is positioned on the side opposite from the developing roller 510 with respect to the first layer 561 (Step s304). In this case as well, it is possible to suppress the occurrence of fogging as well as the occurrence of stripes. It should be noted that FIG. 13 is a flowchart for illustrating a manufacturing method of the developing units 51, 52, 53 and 54.

Furthermore, in the above-described embodiment, the conductive agent is stated to be carbon black CB, as shown in FIG. 5A, but there is no limitation to this. For example, the conductive agent may be any material having conductivity, such as metal powder or metal oxide.

However, carbon black CB is advantageous with regard to cost and can moreover maintain suitable conductivity even in the event of environmental changes. For this reason, the above-described embodiment is preferable.

Furthermore, in the above-described embodiment, the first layer 561 is stated to include an ionic conductive agent, but there is no limitation to this. For example, it is also possible that the first layer 561 does not include an ionic conductive agent.

However, if the first layer 561 includes an ionic conductive agent in addition to carbon black CB, then the amount of carbon black CB may be lower than when no ionic conductive agent is included. In this way, it is possible to reduce the amount of exposed carbon black CB, and the decrease in the charge amount of the toner T borne by the developing roller 510 can be advantageously prevented. For this reason, if the first layer 561 includes an ionic conductive agent, the occurrence of fogging can be advantageously suppressed. For this reason, the above-described embodiment is preferable.

Moreover, in the above-described embodiment, it is stated that the second layer 562 does not contain an ionic conductive agent, but the second layer 562 may contain an ionic conductive agent as well.

Furthermore, it is also possible to include materials other than the base matrix, conductive agent and ionic conductive agent as the materials of the first layer 561, and it is also possible to include materials other than the base matrix and conductive agent as the materials of the second layer 562. Moreover, the base matrix of the first layer 561 and the base matrix of the second layer 562 may be different.

Furthermore, in the above-described embodiment, it is stated that the regulating blade 560 includes a first layer 561 and a second layer 562 containing a conductive agent at a density that is larger than the density of the conductive agent contained in the first layer 561, as shown in FIG. 5A. Moreover, as shown in FIGS. 7A and 7B, when molding the regulating blade 560 by centrifugal molding, the material of the first layer 561 (polymer elastic member, conductive agent, and ionic conductive agent) is supplied into the cylindrical die 923 and the cylindrical die 923 is rotated, and then the material of the second layer 562 (polymer elastic member and conductive agent) is supplied into the cylindrical die 923 and the cylindrical die 923 is rotated. In this case, the die-opposing surface 561*a* of the first layer 561 comes in contact with the developing roller 510, as shown in FIG. 5A. In the following, this regulating blade 560 is referred to as "regulating blade 560 of the first embodiment".

Figure 14:
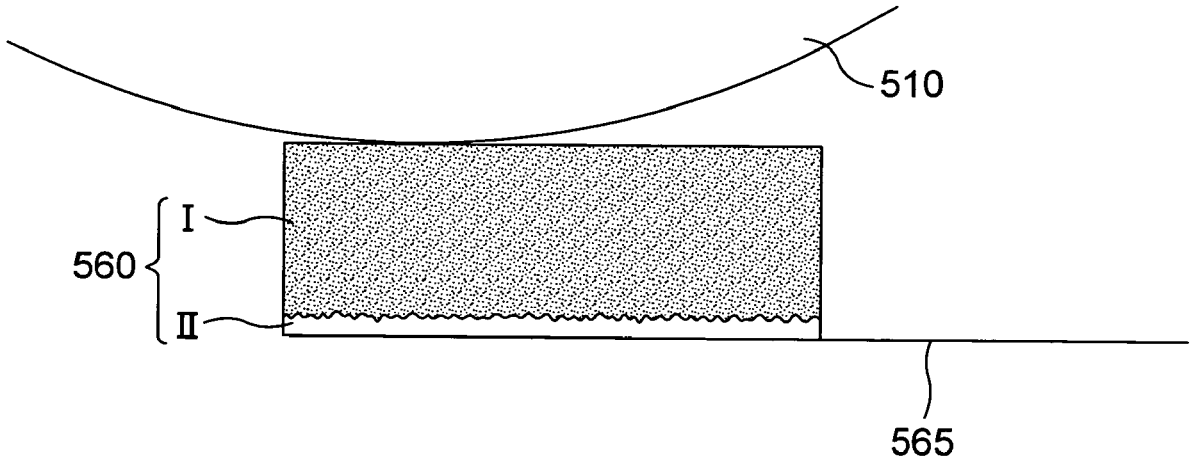
FIG. 14 shows a regulating blade 560 of a fourth embodiment.

However, there is no limitation to this. For example, as shown in FIG. 14, the regulating blade 560 may be made of a singe layer only. FIG. 14 shows a regulating blade 560 of such a fourth embodiment.

It is necessary to disperse a sufficient amount of conductive agent as a whole throughout the regulating blade 560 in order to charge the toner T borne by the developing roller 510 to the desired charge amount. On the other hand, when looking at the portion where the regulating blade 560 is in contact with the developing roller 510, it can be seen that, as use of the developing units 51, 52, 53 and 54 advances, the surface abutting the developing roller 510 is gradually worn off due, for example, to friction caused by the rotation of the developing roller 510, thus exposing the conductive agent. This promotes a lowering of the charge amount of the toner T, due to contact between the toner T and the exposed conductive agent. And when the charge amount of the toner T borne by the developing roller 510 becomes too low, then low-charge-amount toner T that should not be borne by the photoconductor 20 will be borne by the photoconductor 20, and as a result there is a possibility that fogging occurs.

In the case of the regulating blade 560 of the first embodiment, since the regulating blade 560 is divided into two layers, namely the first layer 561 and the second layer 562, and the density of the conductive agent contained in the first layer 561, which is placed in contact with the developing roller 510, is low, the possibility that the conductive agent is exposed is decreased, even when the surface of the first layer 561 contacting the developing roller 510 is worn off. On the other hand, since only the density of the conductive agent contained in the first layer 561 is made low, it becomes possible to ensure a sufficient amount of conductive agent as a whole. Thus, in the case of the regulating blade 560 of the first embodiment, it becomes possible to suppress the occurrence of fogging, because the toner T borne by the developing roller 510 can be appropriately charged, while ensuring a sufficient amount of conductive agent as a whole. With regard to this aspect, the first embodiment is preferable over the fourth embodiment.

Furthermore, in the above-described embodiment, the first layer 561 is stated to contain an ionic conductive agent, but there is no limitation to this. For example, it is also possible that the first layer 561 does not include an ionic conductive agent.

However, an ionic conductive agent tends to be dispersed more uniformly in the base matrix than carbon black CB. Accordingly, if the first layer 561 contains an ionic conductive agent in addition to carbon black CB, then the amount of carbon black CB can be kept smaller than when it contains no ionic conductive agent, so that the possibility that carbon black CB is dispersed non-uniformly can be reduced. For this reason, if the first layer 561 contains an ionic conductive agent, the occurrence of stripes can be advantageously suppressed. For this reason, the above-described embodiment is preferable.

Furthermore, in the above-described embodiment, it is stated that the developing roller 510 is arranged in opposition to the photoconductor 20 (image bearing member) via a gap, as shown in FIG. 4. Furthermore, the printer 10 develops the latent image with the toner T borne by the developing roller 510 by applying a developing bias (voltage obtained by superposing an AC voltage over a DC voltage) to the developing roller 510 (so-called "jumping development").

However, there is no limitation to this. For example, the printer 10 may perform "contact developing" in which development is performed by letting the toner T borne by the developing roller 510 contact the photoconductor 20. In this case, when the toner T borne by the developing roller 510 contacts the photoconductor 20, the toner T rubs against the photoconductor 20 and comes to be borne by the photoconductor 20, so that the possibility of the occurrence of stripes is reduced even when the charge amount of the toner T is non-uniform.

However, in the case of so-called jumping development, different from contact development, the charged toner T is caused to jump between the developing roller 510 and the photoconductor 20 to develop the latent image, due to an electric field formed between the developing roller 510 and the photoconductor 20. Therefore, non-uniformities in the charge amount of the toner T borne by the developing roller 510 tend to affect the developer image formed on the photoconductor 20. Accordingly, if the charge amount of the toner T is non-uniform, stripes tend to occur in the developer image. For this reason, in the case of so-called jumping development, the above-noted effect of being able to suppress the occurrence of stripes can be attained even more advantageously. For this reason, the above-described embodiment is preferable.

Configuration of the Image Forming System etc.

Next, an embodiment of an image forming system serving as an example of an embodiment of the present invention is described with reference to the drawings.

Figure 15:
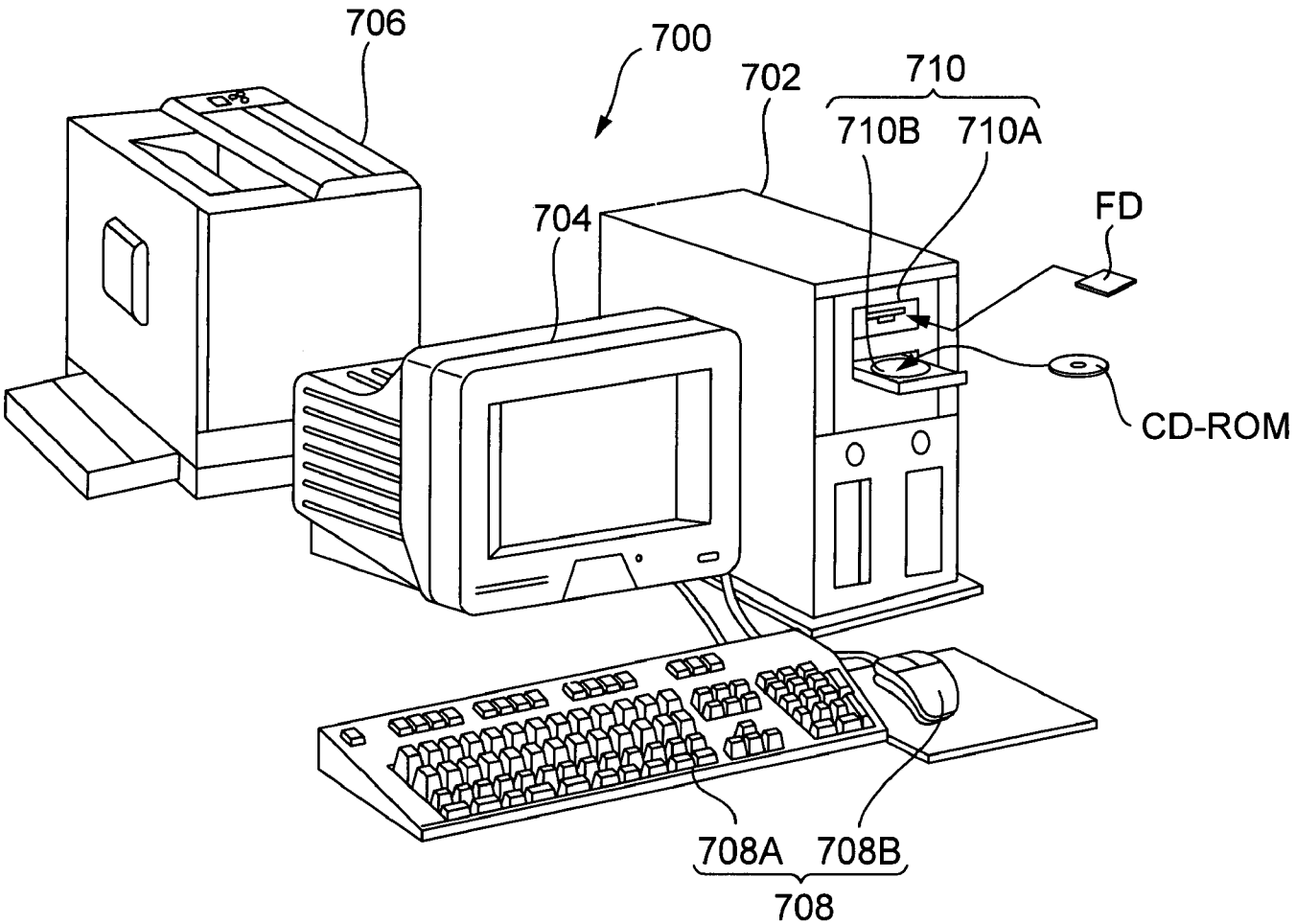
FIG. 15 is an explanatory diagram showing the external structure of an image forming system.

FIG. 15 is an explanatory diagram showing the external structure of the image forming system. An image forming system 700 is provided with a computer 702, a display device 704, a printer 10, an input device 708, and a reading device 710.

In this embodiment, the computer 702 is accommodated within a mini-tower type housing; however, there is no limitation to this. A CRT (cathode ray tube), plasma display, or liquid crystal display device, for example, is generally used as the display device 704, but there is no limitation to this. The printer 10 is the printer described above. In this embodiment, the input device 708 is a keyboard 708A and a mouse 708B, but there is no limitation to these. In this embodiment, a flexible disk drive 710A and a CD-ROM drive 710B are used as the reading device 710, but there is no limitation to these, and the reading device 710 may also be an MO (magnet optical) disk drive or a DVD (digital versatile disk), for example.

Figure 16:
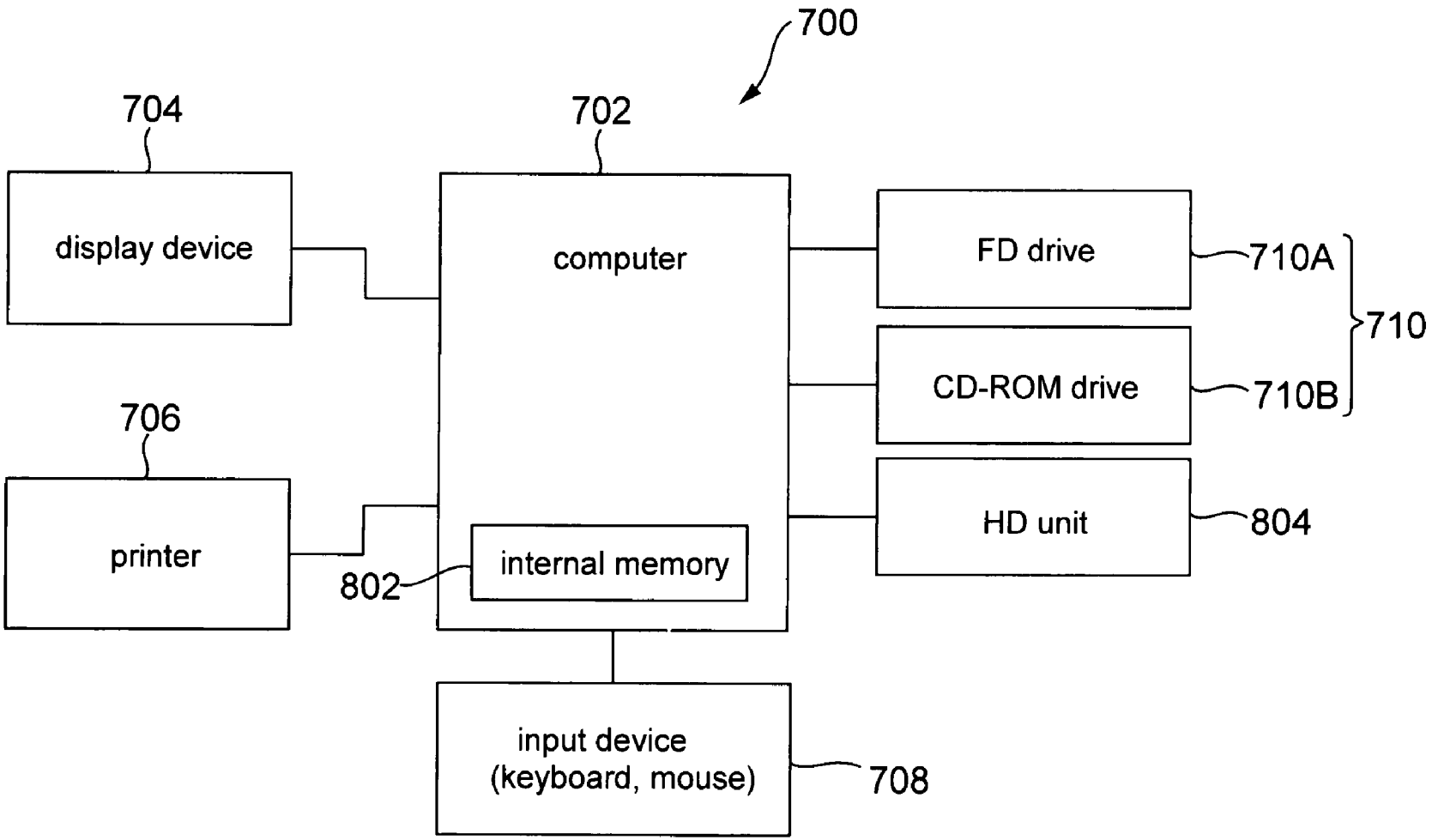
FIG. 16 is a block diagram showing the configuration of the image forming system shown in FIG. 15.

FIG. 16 is a block diagram showing the configuration of the image forming system shown in FIG. 15. An internal memory 802 such as a RAM is provided within the housing accommodating the computer 702, and also an external memory such as a hard disk drive unit 804 is provided.

In the above description, an example was described in which the image forming system is constituted by connecting the printer 10 to the computer 702, the display device 704, the input device 708, and the reading device 710, but there is no limitation to this. For example, the image forming system can be made of the computer 702 and the printer 10, and the image forming system does not have to be provided with all of the display device 704, the input device 708, and the reading device 710.

It is also possible for the printer 10 to have some of the functions or mechanisms of the computer 702, the display device 704, the input device 708, and the reading device 710. For example, the printer 10 may be configured so as to have an image processing section for carrying out image processing, a display section for carrying out various types of displays, and a recording media attachment/detachment section to and from which recording media storing image data captured by a digital camera or the like are inserted and taken out.

As an overall system, the image forming system that is thus achieved is superior to conventional systems.

What is claimed is:

1. A developing device comprising:

a developer bearing member for bearing a developer; and a charging member for charging the developer borne by said developer bearing member, said charging member having:

a first layer that is placed in contact with said developer bearing member and that contains a conductive agent; and a second layer that is positioned on a side opposite from said developer bearing member with respect to said first layer, and that contains a conductive agent at a density that is greater than the density of the conductive agent contained in said first layer.

2. A developing device according to claim 1, wherein said charging member is molded by centrifugal molding, in which a material of said charging member is supplied into a hollow die having an inner wall, and said die is rotated to mold said charging member.

3. A developing device according to claim 2, wherein, to mold said charging member by centrifugal molding, a material of said first layer is supplied into said die and said die is rotated, and then a material of said second layer is supplied into said die and said die is rotated.

4. A developing device according to claim 1, wherein said conductive agent is carbon black.

5. A developing device according to claim 1, wherein said first layer contains an ionic conductive agent.

6. A developing device comprising:

a developer bearing member for bearing a developer; and a charging member for charging the developer borne by said developer bearing member, said charging member having:

a first layer that is placed in contact with said developer bearing member and that contains a conductive agent; and a second layer that is positioned on a side opposite from said developer bearing member with respect to said first layer, and that contains a conductive agent at a density that is greater than the density of the conductive agent contained in said first layer;

wherein said charging member is molded by centrifugal molding, in which a material of said charging member is supplied into a hollow die having an inner wall, and said die is rotated to mold said charging member;

wherein, to mold said charging member by centrifugal molding, a material of said first layer is supplied into said die and said die is rotated, and then a material of said second layer is supplied into said die and said die is rotated;

wherein said conductive agent is carbon black; and wherein said first layer contains an ionic conductive agent.

7. An image forming apparatus comprising:

an image bearing member for bearing a latent image; and a developing device for developing the latent image borne by said image bearing member, said developing device including:

a developer bearing member for bearing a developer; and a charging member for charging the developer borne by said developer bearing member, said charging member having:

a first layer that is placed in contact with said developer bearing member and that contains a conductive agent; and a second layer that is positioned on a side opposite from said developer bearing member with respect to said first layer, and that contains a conductive agent at a density that is greater than the density of the conductive agent contained in said first layer.

8. An image forming system comprising:

a computer; and an image forming apparatus that can be connected to said computer and that is provided with:

an image bearing member for bearing a latent image; and a developing device for developing the latent image borne by said image bearing member, said developing device including:

a developer bearing member for bearing a developer; and a charging member for charging the developer borne by said developer bearing member, said charging member having:

a first layer that is placed in contact with said developer bearing member and that contains a conductive agent; and a second layer that is positioned on a side opposite from said developer bearing member with respect to said first layer, and that contains a conductive agent at a density that is greater than the density of the conductive agent contained in said first layer.

9. A charging member for charging a developer borne by a developer bearing member, said charging member comprising:

a first layer that is placed in contact with said developer bearing member and that contains a conductive agent; and a second layer that is positioned on a side opposite from said developer bearing member with respect to said first layer, and that contains a conductive agent at a density that is greater than the density of the conductive agent contained in said first layer.

10. A method for manufacturing a developing device, said developing device including a developer bearing member for bearing a developer and a charging member for charging the developer borne by said developer bearing member, said charging member having a first layer that contains a conductive agent and a second layer that contains a conductive agent at a density that is greater than the density of the conductive agent contained in said first layer, said method comprising:

a step of molding said charging member through centrifugal molding, by:

supplying a material of said first layer into a hollow die having an inner wall and rotating said die, and then supplying a material of said second layer into said hollow die and rotating said die; and a step of placing said first layer of said charging member molded by said centrifugal molding in contact with said developer bearing member, and positioning said second layer of said charging member on a side opposite from said developer bearing member with respect to said first layer.

11. A developing device comprising:

a developer bearing member for bearing a developer; and a charging member for charging the developer borne by said developer bearing member, said charging member containing a conductive agent, said charging member being molded through centrifugal molding by supplying a material of said charging member into a hollow die having an inner wall and rotating said die, a surface of said charging member that is on a side proximate to said inner wall being placed in contact with said developer bearing member.

12. A developing device according to claim 11, wherein said conductive agent is carbon black.

13. A developing device according to claim 11, wherein said charging member has a first layer, and a second layer containing a conductive agent at a density that is greater than the density of the conductive agent contained in said first layer; and wherein, to mold said charging member by centrifugal molding, a material of said first layer is supplied into said die and said die is rotated, and then a material of said second layer is supplied into said die and said die is rotated.

14. A developing device according to claim 13, wherein said first layer contains an ionic conductive agent.

15. A developing device comprising:

a developer bearing member for bearing a developer; and a charging member for charging the developer borne by said developer bearing member, said charging member containing a conductive agent, said charging member being molded through centrifugal molding by supplying a material of said charging member into a hollow die having an inner wall and rotating said die, a surface of said charging member that is on a side proximate to said inner wall being placed in contact with said developer bearing member;

wherein said conductive agent is carbon black;

wherein said charging member has a first layer, and a second layer containing a conductive agent at a density that is greater than the density of the conductive agent contained in said first layer;

wherein, to mold said charging member by centrifugal molding, a material of said first layer is supplied into said die and said die is rotated, and then a material of said second layer is supplied into said die and said die is rotated; and wherein said first layer contains an ionic conductive agent.

16. An image forming apparatus comprising:

an image bearing member for bearing a latent image; and a developing device for developing the latent image borne by said image bearing member, said developing device including:

a developer bearing member for bearing a developer; and a charging member for charging the developer borne by said developer bearing member, said charging member containing a conductive agent, said charging member being molded through centrifugal molding by supplying a material of said charging member into a hollow die having an inner wall and rotating said die, a surface of said charging member that is on a side proximate to said inner wall being placed in contact with said developer bearing member.

17. An image forming apparatus according to claim 16, wherein said developer bearing member is arranged in opposition to said image bearing member with a gap therebetween; and wherein said latent image is developed with said developer borne by said developer bearing member by applying, to said developer bearing member, a voltage obtained by superposing an AC voltage over a DC voltage.

18. An image forming system comprising:

a computer; and an image forming apparatus that can be connected to said computer and that is provided with:

an image bearing member for bearing a latent image; and a developing device for developing the latent image borne by said image bearing member, said developing device including:

a developer bearing member for bearing a developer; and a charging member for charging the developer borne by said developer bearing member, said charging member containing a conductive agent, said charging member being molded through centrifugal molding by supplying a material of said charging member into a hollow die having an inner wall and rotating said die, a surface of said charging member that is on a side proximate to said inner wall being placed in contact with said developer bearing member.

19. A charging member for charging a developer borne by a developer bearing member, wherein:

said charging member contains a conductive agent;

said charging member is molded through centrifugal molding by supplying a material of said charging member into a hollow die having an inner wall and rotating said die; and a surface of said charging member that is on a side proximate to said inner wall is placed in contact with said developer bearing member.

20. A method for manufacturing a developing device, said developing device including a developer bearing member for bearing a developer and a charging member for charging the developer borne by said developer bearing member, said charging member containing a conductive agent, said method comprising:

a step of molding said charging member through centrifugal molding, by:

supplying a material of said charging member into a hollow die having an inner wall and rotating said die; and a step of placing, in contact with said developer bearing member, a surface of said charging member molded by said centrifugal molding that is on a side proximate to said inner wall.

* * * * *